US011415927B2

(12) United States Patent
Ikegami et al.

(10) Patent No.: US 11,415,927 B2
(45) Date of Patent: Aug. 16, 2022

(54) IMAGE FORMING APPARATUS

(71) Applicant: Brother Kogyo Kabushiki Kaisha, Nagoya (JP)

(72) Inventors: Yusuke Ikegami, Nagoya (JP); Shintaro Sakaguchi, Nagoya (JP); Kotaro Haruta, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/345,145

(22) Filed: Jun. 11, 2021

(65) Prior Publication Data

US 2022/0019168 A1 Jan. 20, 2022

(30) Foreign Application Priority Data

Jul. 14, 2020 (JP) ..... JP2020-120827

(51) Int. Cl.
*G03G 15/00* (2006.01)
*G03G 21/16* (2006.01)
(Continued)

(52) U.S. Cl.
CPC ..... *G03G 21/0041* (2013.01); *G03G 15/0815* (2013.01); *G03G 15/0863* (2013.01);
(Continued)

(58) Field of Classification Search
CPC ..... G03G 15/0815; G03G 15/0863; G03G 15/80; G03G 21/0041; G03G 21/1633; G03G 21/1647; G03G 21/1864; G03G 15/0896; G03G 21/1671; G03G 21/1676; G03G 21/1821
See application file for complete search history.

(56) References Cited

U.S. PATENT DOCUMENTS 8,953,979 B2 * 2/2015 Mori ..... G03G 21/1633 399/110
11,209,744 B2 * 12/2021 Saeki ..... G03G 21/1647
(Continued)

FOREIGN PATENT DOCUMENTS

JP 2003-270894 A 9/2003
JP 2004-133259 A 4/2004
(Continued)

*Primary Examiner* — Sophia S Chen
(74) *Attorney, Agent, or Firm* — Burr & Brown, PLLC

(57) ABSTRACT

An image forming apparatus according to aspects of the present disclosure includes a cover, an interlocking mechanism, a sensor, a separation mechanism, a controller. In a state where the cover moves from a closed position to an open position while no power is supplied to the controller, a state of the interlocking mechanism changes from a first state to a second state. In a state where the sensor does not detect that the interlocking mechanism is in the second state when power supply to the controller is started, the separation mechanism keeps the developing roller located at a separation position at the separation position. On the other hand, in a state where the sensor detects that the interlocking mechanism is in the second state when power supply to the controller is started, the separation mechanism moves the developing roller located at a contact position to the separation position.

14 Claims, 16 Drawing Sheets

(51) Int. Cl.
*G03G 21/00* (2006.01)
*G03G 15/08* (2006.01)
*G03G 21/18* (2006.01)

(52) U.S. Cl.
CPC ..... *G03G 15/80* (2013.01); *G03G 21/1633* (2013.01); *G03G 21/1821* (2013.01)

(56) References Cited

U.S. PATENT DOCUMENTS

| | | | | |
|---|---|---|---|---|
| 2009/0214235 | A1 | 8/2009 | Hattori | |
| 2021/0200140 | A1* | 7/2021 | Sano ..... | G03G 21/1633 |

FOREIGN PATENT DOCUMENTS

| | | | |
|---|---|---|---|
| JP | 2009-204838 | A | 9/2009 |
| JP | 2010-271490 | A | 12/2010 |

* cited by examiner

122

IMAGE FORMING APPARATUS

CROSS-REFERENCE TO RELATED APPLICATIONS

This application claims priority under 35 U.S.C. § 119 from Japanese Patent Application No. 2020-120827 filed on Jul. 14, 2020. The entire subject matter of the application is incorporated herein by reference.

BACKGROUND

Technical Field

The present disclosures relate to an image forming apparatus.

Related Art

Conventionally, there has been known an image forming apparatus having a housing with an opening, a cover, an interlocking mechanism, a sensor, and a controller. The cover is generally configured to move between a closed position at which the cover covers the opening and an open position at which the cover uncovers the opening. The interlocking mechanism typically includes a cam that interlocks with the cover. The cam is configured to move a developing roller away from a photosensitive drum.

SUMMARY

According to a conventional configuration, there is known a configuration in which the controller moves the cam after the image forming apparatus is powered on and determines whether the cover was opened or closed during the image forming apparatus was powered off based on a time until the sensor detects the cam.

In the above-mentioned conventional configuration, the controller is typically configured to move the cam every time when the image forming apparatus is powered on in order to determine whether the cover was opened or closed while the image forming apparatus was powered off.

In such a configuration, even if the developing roller is in a state of being separated from the photosensitive drum at a time when the image forming apparatus is powered on, the developing roller is once brought into contact with the photosensitive drum and then separated from the drum.

Such a configuration causes the developing roller to come into contact with the photosensitive drum even when the developing roller does not need to contact the photosensitive drum.

According to aspects of the present disclosures, there is provided an image forming apparatus including a housing formed with an opening, a cover configured to be movable between a closed position at which the cover closes the opening and an open position at which the cover uncovers the opening, a photosensitive drum, a developing roller movable between a contact position at which the developing roller contacts the photosensitive drum and a separation position at which the developing roller is spaced from the photosensitive drum, a separation mechanism configured to move the developing roller from the contact position to the separation position, the separation mechanism allowing movement of the developing roller from the separation position to the contact position in association with a movement of the cover from the closed position to the open position, a controller configured to control the separation mechanism to move the developing roller between the separation position and the contact position, an interlocking mechanism configured to change a state from a first state to a second state in association with movement of the cover from the closed position to the open position in a case where the cover moves from the closed position to the open position while no power is supplied is to the controller, and a sensor configured to detect whether the interlocking mechanism is in the second state. The separation mechanism is configured to in a case where the sensor does not detect that the interlocking mechanism is in the second state when power supply to the controller is started, keep the developing roller located at the separation position at the separation position, and in a case where the sensor detects that the interlocking mechanism is in the second state when power supply to the controller is started, move the developing roller located at the contact position to the separation position.

According to aspects of the present disclosures, there is provided an image forming apparatus, including a housing formed with an opening, a cover configured to be movable between a closed position at which the cover closes the opening and an open position at which the cover uncovers the opening, a photosensitive drum, a developing roller movable between a contact position at which the developing roller contacts the photosensitive drum and a separation position at which the developing roller is spaced from the photosensitive drum, a separation mechanism configured to move the developing roller from the contact position to the separation position, the separation mechanism allowing movement of the developing roller from the separation position to the contact position in association with a movement of the cover from the closed position to the open position, a controller configured to control the separation mechanism to move the developing roller between the separation position and the contact position, an interlocking mechanism configured to change a state from a first state to a second state in association with movement of the cover from the closed position to the open position in a case where the cover moves from the closed position to the open position while no power is supplied is to the controller, and a sensor configured to detect whether the interlocking mechanism is in the second state. The separation mechanism is configured to in a case where the sensor does not detect that the interlocking mechanism is in the second state when power supply to the controller is started, perform a first warm-up process of causing the separation mechanism to keep the developing roller located at the separation position at the separation position, and, in a case where the sensor detects that the interlocking mechanism is in the second state when power supply to the controller is started, perform a second warm-up process of causing the separation mechanism to move the developing roller located at the contact position to the separation position.

DETAILED DESCRIPTION OF THE EMBODIMENTS

1. Overview of Image Forming Apparatus 1

Figure 1:
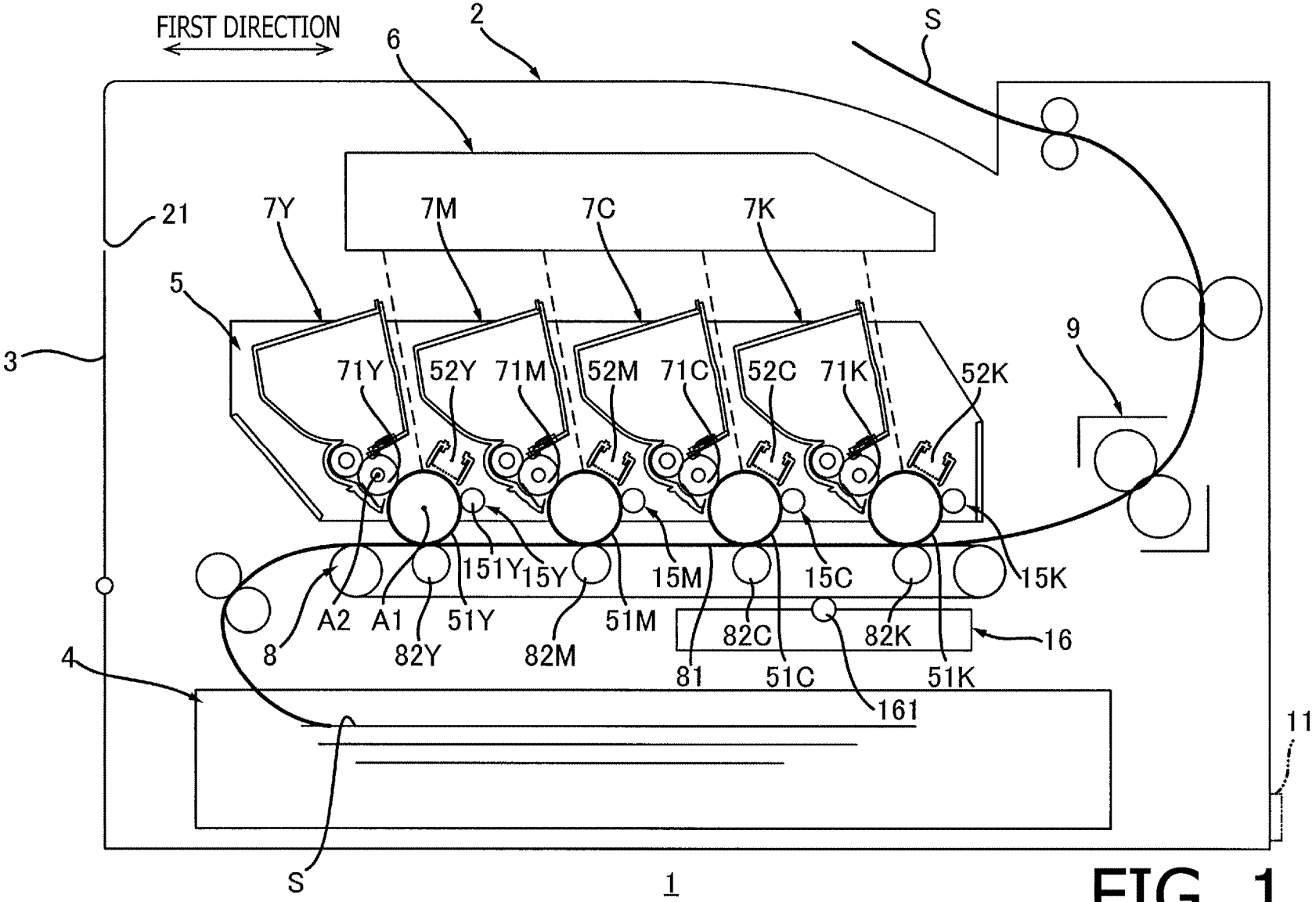
FIG. 1 shows a schematic configuration of an image forming apparatus according to an embodiment of the present disclosure.
Figure 2:
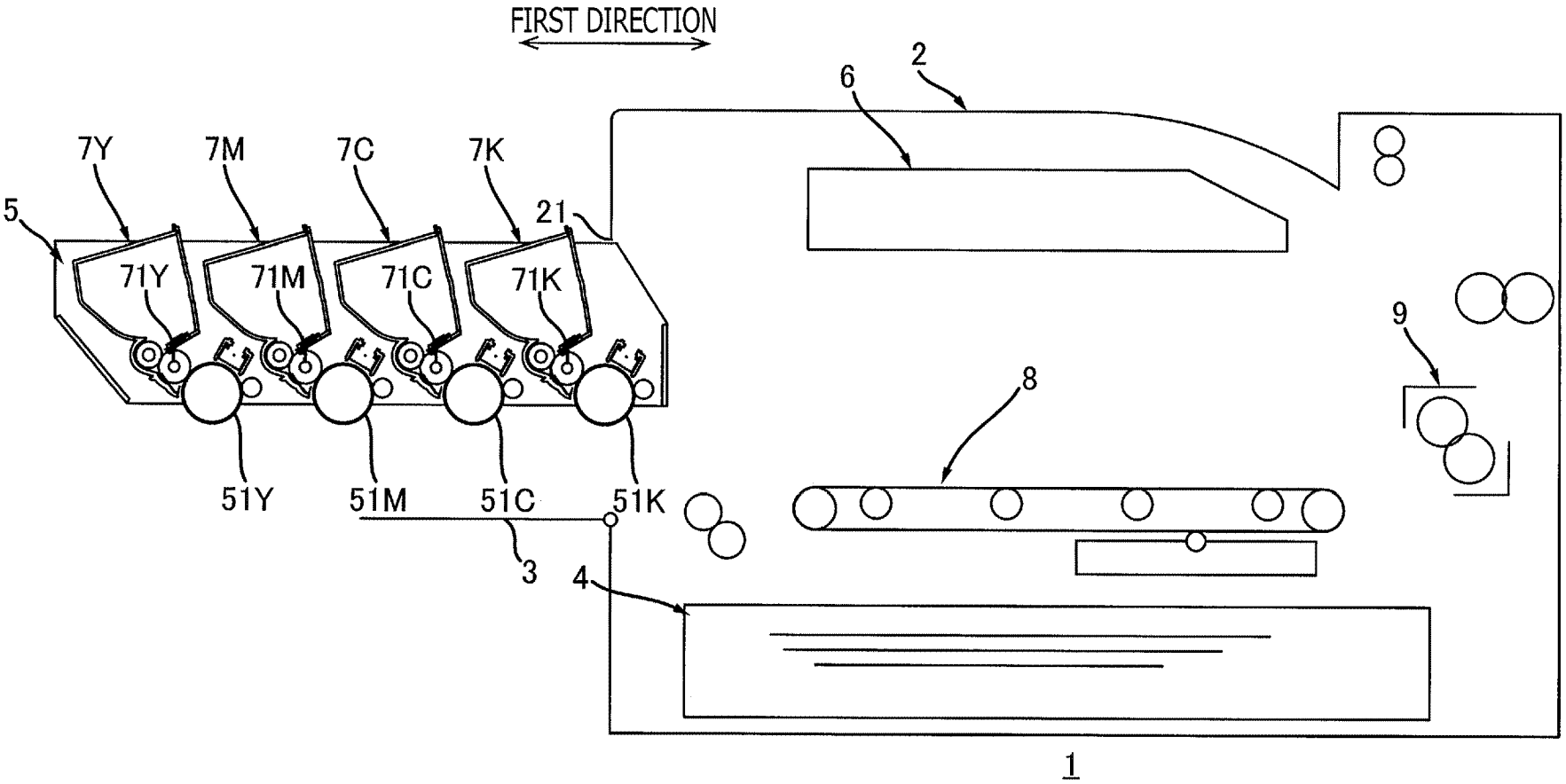
FIG. 2 schematically shows the image forming apparatus shown in FIG. 1, with a cover being located at an open position and a drum unit being located at an outer position.
Figure 3:
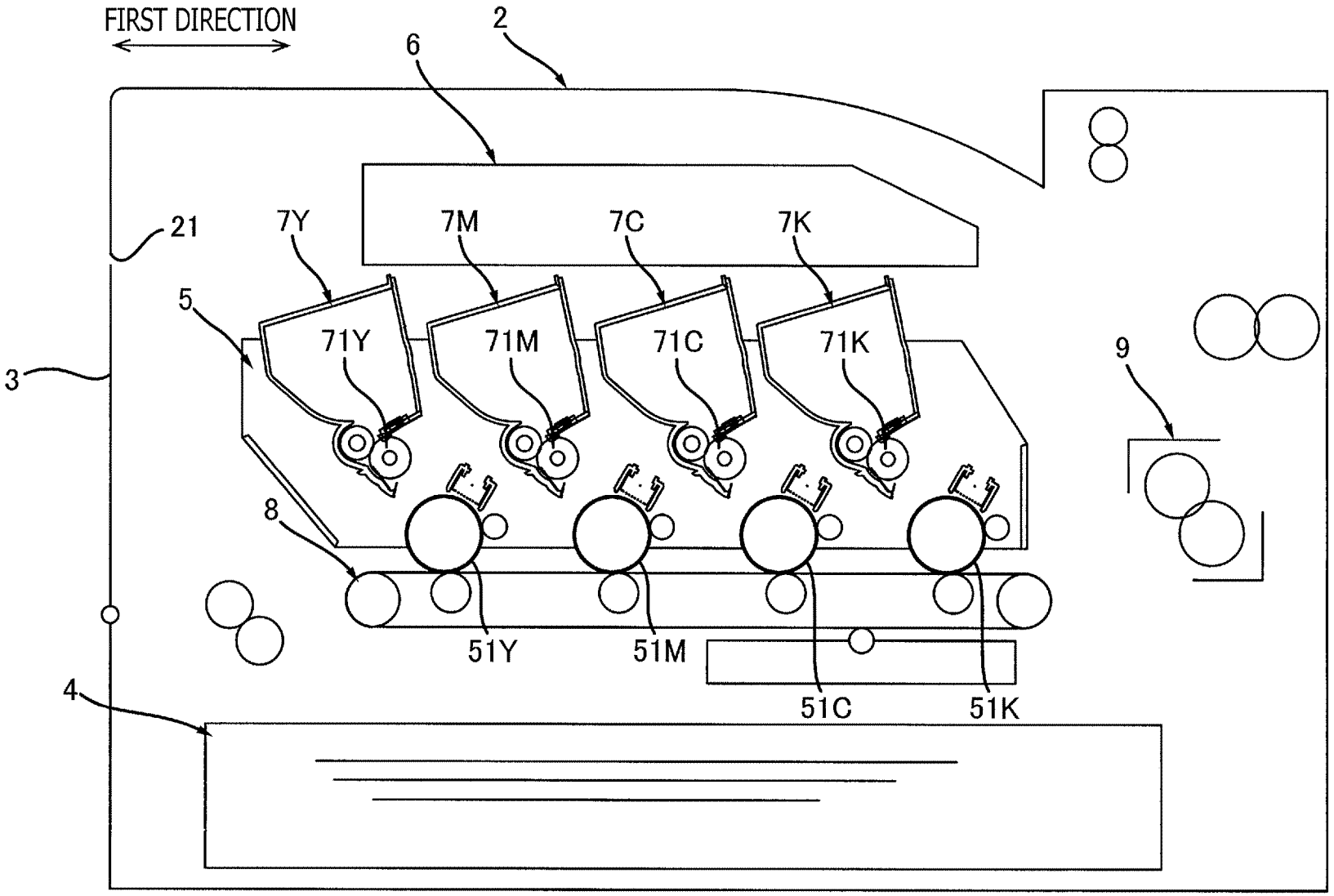
FIG. 3 schematically shows the image forming apparatus shown in FIG. 1, with developing rollers being in separation positions.

Referring to FIGS. 1 through 3, an overview of an image forming apparatus 1 will be described.

As shown in FIG. 1, the image forming apparatus 1 is equipped with a housing 2, a cover 3, a sheet container 4, a drum unit 5, an exposure device 6, a plurality of developer cartridges 7Y, 7M, 7C, 7K, a transfer device 8, and a fusing device 9.

In the following description, suffixes "Y," "M," "C" and "K" will be added to reference numerals to indicate that components are for colors of yellow, magenta, cyan and black, respectively. For example, the developer cartridge 7Y is the developer cartridge for yellow toner (i.e., accommodating yellow toner), the developer cartridge 7M is for magenta toner, the developer cartridge 7C is for cyan toner, and the developer cartridge 7K is for black toner. It is noted that the order of the "Y," "M," "C" and "K" according to the present embodiment is only an example, and a different order can be employed arbitrarily. Further, the colors of yellow, magenta, cyan and black are examples, and different colors may be used.

1.1 Housing 2

The housing 2 houses the sheet container 4, the drum unit 5, the exposure device 6, the plurality of developer cartridges 7Y, 7M, 7C and 7K, the transfer device 8, and the fixing device 9. The housing 2 has an opening 21.

1.2 Cover 3

The cover 3 is configured to move between a closed position (see FIG. 1) and an open position (see FIG. 2). When the cover 3 is located at the closed position, the cover 3 closes the opening 21. When the cover 3 is located at the open position, the cover 3 uncovers the opening 21, which is exposed to the outside.

1.3 Sheet Container 4

The sheet container 4 is configured to accommodate a plurality of sheets S. The sheets S in the sheet container 4 are fed toward a photosensitive drum 51Y, one by one. The sheet S is, for example, a printing sheet. The sheet container 4 may be a sheet cassette.

1.4 Drum Unit 5

As shown in FIG. 2, in a state where the cover 3 is located at the open position, the drum unit 5 can be moved, in a first direction, between an inner position (see FIG. 1) and an outer position (see FIG. 2) through the opening 21. When the drum unit 5 is located at the inner position, the drum unit 5 is located inside the housing 2. When the drum unit 5 is located at the outer position, the drum unit 5 is located outside the housing 2.

As shown in FIG. 1, the drum unit 5 has a plurality of photosensitive drums 51Y, 51M, 51C and 51K, and a plurality of chargers 52Y, 52M, 52C and 52K. In other words, the image forming apparatus 1 has the photosensitive drums 51Y.

1.4.1 Photosensitive Drums 51Y, 51M, 51C and 51K

The photosensitive drums 51Y, 51M, 51C and 51K are arranged in the first direction. Each of the photosensitive drums 51M, 51C and 51K has the same structure as the photosensitive drum 51Y. For this reason, the photosensitive drum 51Y will be described in the following description, and descriptions on the photosensitive drums 51M, 51C, and 51K will be omitted.

The photosensitive drum 51Y extends in a second direction intersecting with the first direction. Preferably, the second direction is orthogonal to the first direction. The photosensitive drum 51Y is rotatable about a drum axis A1 that extends in the second direction.

1.4.2 Chargers 52Y, 52M, 52C and 52K

The charger 52Y is configured to charge a surface of the photoreceptor drum 51Y. The charger 52M is configured to charge a surface of the photosensitive drum 51M. The charger 52C is configured to charge a surface of the photosensitive drum 51C. The charger 52K is configured to charge a surface of the photosensitive drum 51K.

1.5 Exposure Device 6

In a state where the drum unit 5 is positioned at the inner position, the exposure device 6 exposes the photosensitive drum 51Y, which has been charged by the charger 52Y. According to the present embodiment, the exposure device 6 includes a laser scanning device. The exposure device 6 is configured to expose not only the photosensitive drum 51Y but also the photosensitive drums 51M, 51C, and 51K. The exposure device 6 may be an exposure head having an LED array.

1.6 Developer Cartridges 7Y, 7M, 7C and 7K

As shown in FIG. 2, in a state where the cover 3 is located at the open position and the drum unit 5 is located at the outer position, the developer cartridges 7Y, 7M, 7C and 7K are attachable to the drum unit 5.

As shown in FIG. 1, when the developer cartridges 7Y, 7M, 7C and 7K are attached to the drum unit 5 and the drum unit 5 is located at the inner position, the developer cartridges 7Y, 7M, 7C and 7K may be attached inside the housing 2. In a state where the cover 3 is located at the open position, the developer cartridges 7Y, 7M, 7C and 7K may be attached inside the housing 2 through the opening 21.

Each of the developer cartridges 7M, 7C and 7K has the same structure as the developer cartridge 7Y. Therefore, the description of the developer cartridge 7Y will be given and the description of the developer cartridges 7M, 7C and 7K will be omitted.

The developer cartridge 7Y is configured to contain toner. The developer cartridge 7Y has a developing roller 71Y. In other words, the image forming apparatus 1 has a developing roller 71Y. The developing cartridges 7M, 7C and 7K have respective developer rollers 71M, 71C and 71K, similar to those described in connection with the developer cartridge 7Y.

The developing roller 71Y extends in the second direction. The developing roller 71Y is rotatable about a developing axis A2. The developing axis A2 extends in the second direction.

As shown in FIGS. 1 and 3, in a state where the developer cartridge 7Y is attached to the drum unit 5 and the drum unit 5 is located at the inner position, the developer cartridge 7Y is movable between a position where the developing roller 71Y contacts the photosensitive drum 51Y (see FIG. 1) and a position where the developing roller 71Y is spaced from the photosensitive drum 51Y (see FIG. 3). In other words, the developing roller 71Y can move between a contact position (see FIG. 1) and a separation position (see FIG. 3). In a state where the developing roller 71Y is located at the contact position, the developing roller 71Y is in contact with the photosensitive drum 51Y. In a state where the developing roller 71Y is located at the separation position, the developing roller 71Y is spaced from the photosensitive drum 51Y.

As shown in FIG. 1, in a state where the developing roller 71Y is located at the contact position, the developing roller 71Y is capable of supplying toner accommodated in the developer cartridge 7Y to the photosensitive drum 51Y.

1.7 Transfer Device 8

The transfer device 8 has a belt 81 and a plurality of transfer rollers 82Y, 82M, 82C and 82K.

In a state where the drum unit 5 is located at the inner position, the belt 81 is in contact with the photosensitive drums 51Y, 51M, 51C and 51K. The belt 81 is configured to convey the sheet S fed from the sheet container 4 toward the fixing unit 9.

The transfer roller 82Y is configured to transfer the toner on the photosensitive drum 51Y to the sheet S which is being conveyed by the belt 81. In other words, the transfer device 8 transfers the toner on the photoreceptor drum 51Y to the sheet S. Similarly, the transfer roller 82M transfers the toner on the photosensitive drum 51M to the sheet S being conveyed by the belt 81. The transfer roller 82C transfers the toner on the photoreceptor drum 51C to the sheet S being conveyed by the belt 81. The transfer roller 82K transfers the toner on the photoreceptor drum 51K to the sheet S being conveyed by the belt 81.

1.8 Fixing Device 9

The fixing device 9 is configured to apply heat and pressure to the sheet S on which the toner has been transferred by the transfer rollers 82Y, 82M, 82C and 82K to fix the toner on the sheet S. The sheet S that has passed through the fixing device 9 is discharged on an upper surface of the housing 2.

2. Details of the Image Forming Apparatus 1

Referring to FIG. 1 and FIGS. 3 through 14B, the details of the image forming apparatus 1 will be described.

Figure 4:
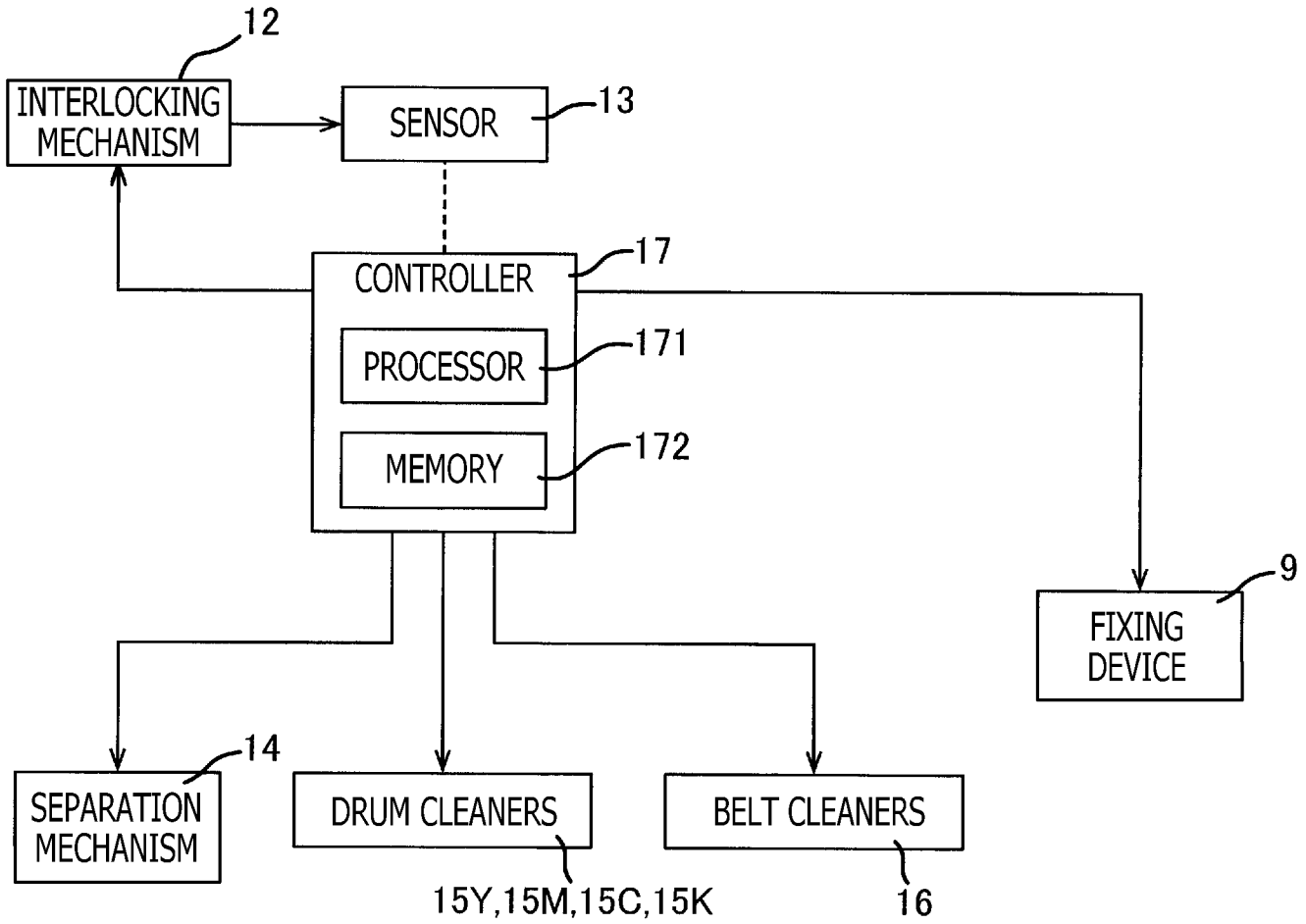
FIG. 4 is a block diagram illustrating a control of the image forming apparatus.

As shown in FIGS. 1 and 4, the image forming apparatus 1 is equipped with a power switch 11 (see FIG. 1), the interlocking mechanism 12 (see FIG. 4), the sensor 13 (see FIG. 4), the separation mechanism 14 (see FIG. 4), a plurality of drum cleaners 15Y, 15M, 15C and 15K (see FIG. 1), a belt cleaner 16 (see FIG. 1), and a controller 17 (see FIG. 4).

2.1 Power Switch 11

As shown in FIG. 1, the power switch 11 is arranged on an outer surface of the housing 2. The power switch 11 can be switched between an on state and an off state. In a state where the power switch 11 is in the on state, power to the controller 17. In a state where the power switch 11 is in the off state, the power supply to the controller 17 is stopped.

2.2 Interlocking Mechanism 12

Figure 5B:
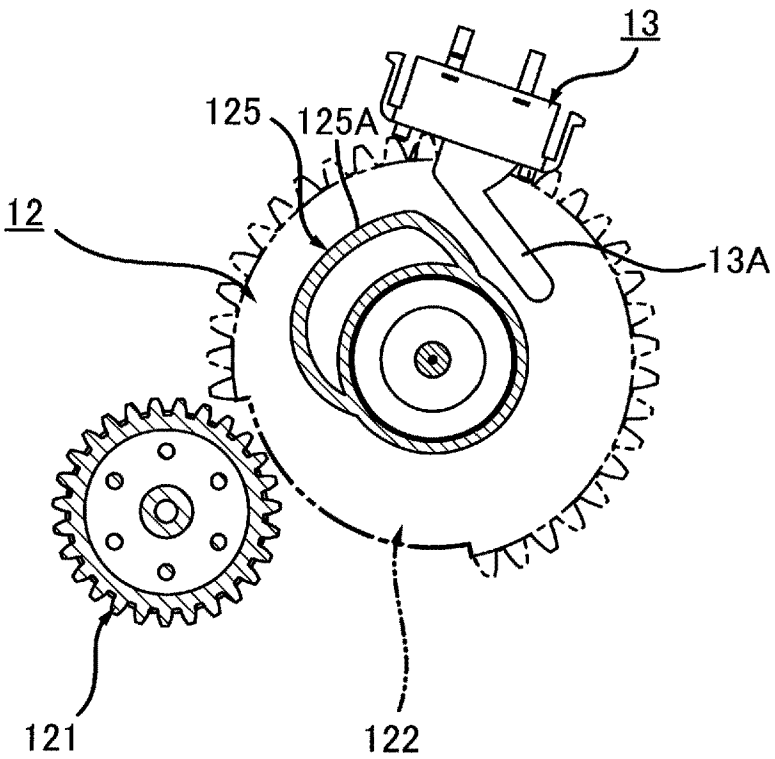
FIG. 5B shows the interlocking mechanism shown in FIG. 5A, in a state where a contact member is separated from a lever of a sensor.
Figure 5A:
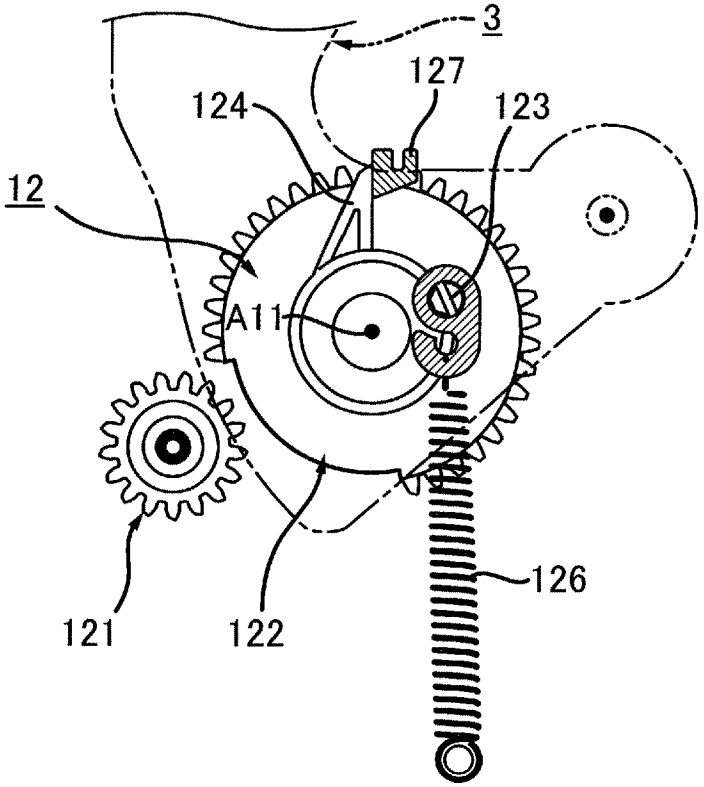
FIG. 5A shows an interlocking mechanism shown in FIG. 4, in a state where the cover is located at the closed position and the interlocking mechanism is in a first state.
Figure 6B:
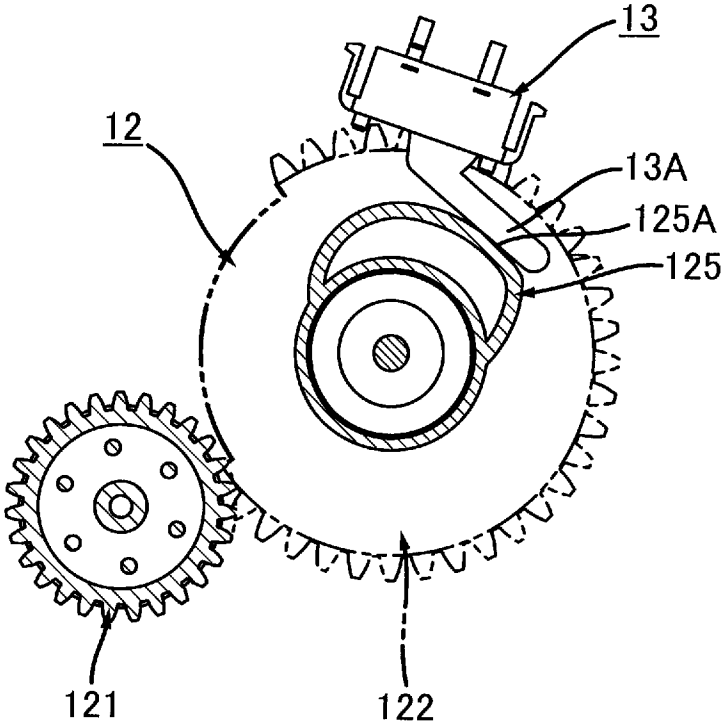
FIG. 6B shows the interlocking mechanism shown in FIG. 6A, in a state where the contact member is pressing the lever of the sensor.
Figure 6A:
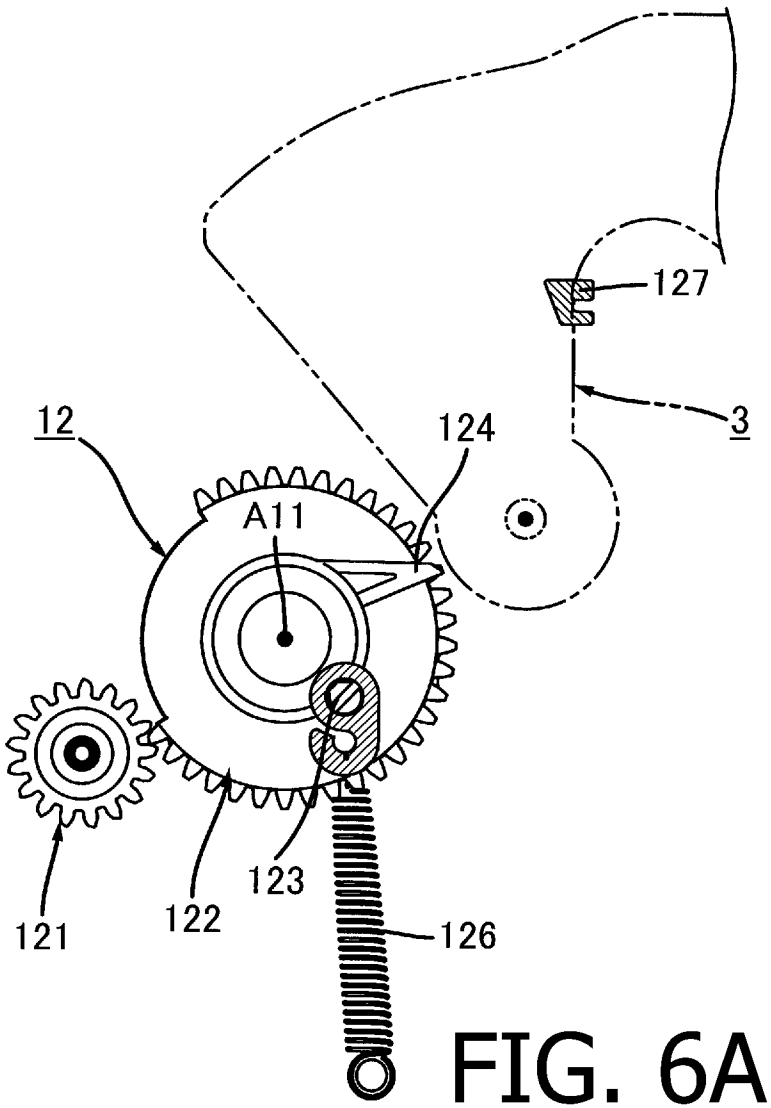
FIG. 6A shows the interlocking mechanism shown in FIG. 5A, in a state where the cover is located at the open position and the interlocking mechanism is in a second state.

As shown in FIGS. 5A and 6A, the state of the interlocking mechanism 12 switches from the first state (see FIG. 5A) to the second state (see FIG. 6A) in conjunction with the movement of the cover 3 from the closed position (see FIG. 5A) to the open position (see FIG. 6A). That is, in a case where the cover 3 moves from the closed position to the open position while the power is not supplied to the controller 17, the interlocking mechanism 12 switches from the first state to the second state in conjunction with the movement of the cover 3 from the closed position to the open position.

Figure 7:
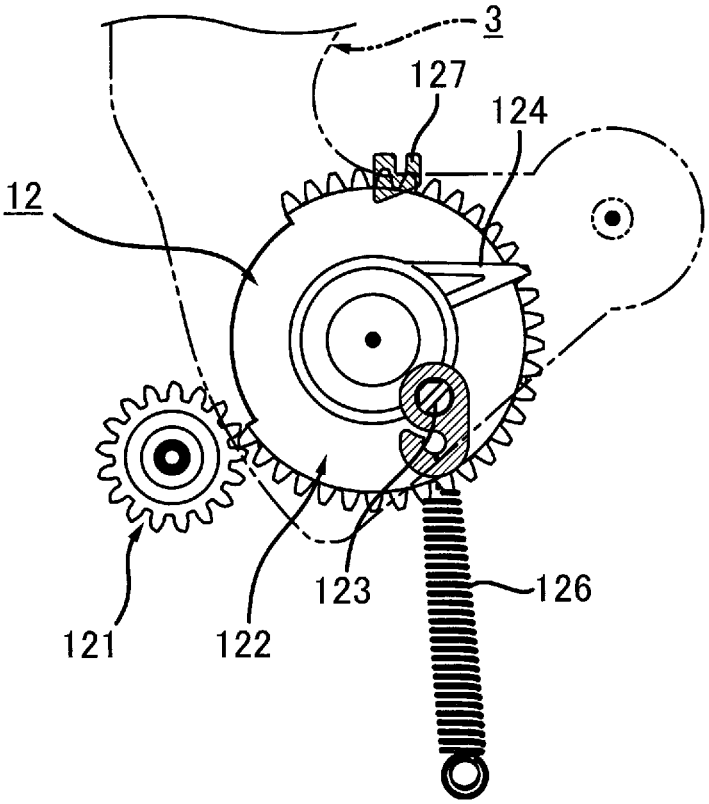
FIG. 7 shows the interlocking mechanism shown in FIG. 5A, in a state where the interlocking mechanism is in a second state and the cover is located at the closed position.

On the other hand, as shown in FIG. 6A and FIG. 7, the interlocking mechanism 12 is not associated with the movement of the cover 3 from the open position to the closed position, but remains in the second state.

In detail, as shown in FIGS. 5A and 5B, the interlocking mechanism 12 has a drive gear 121, a sector gear 122, a protrusion 123, a protrusion 124, a contact member 125 (see FIG. 5B), a spring 126 and a stopper 127.

2.2.1 Drive Gear 121

The drive gear 121 is configured to be rotatable by receiving power from a motor not shown in the drawings.

2.2.2 Sector Gear 122

The sector gear 122 is rotatable about the axis A11 between a sector first position (see FIG. 5A) and a sector second position (see FIG. 6A). According to the present embodiment, the axis A11 extends in the second direction. As shown in FIG. 5A, in a state where the sector gear 122 is located at the sector first position, the sector gear 122 does not mesh with the drive gear 121. On the other hand, as shown in FIG. 6A, in a state where the sector gear 122 is located at the sector second position, the sector gear 122 meshes with the drive gear 121. The sector gear 122 meshes with the drive gear 121 at a position between the sector second position (see FIG. 6A) and the sector first position (see FIG. 5A). Then, the sector gear 122 moves from the sector second position to the sector first position by the power from the drive gear 121.

Figure 8:
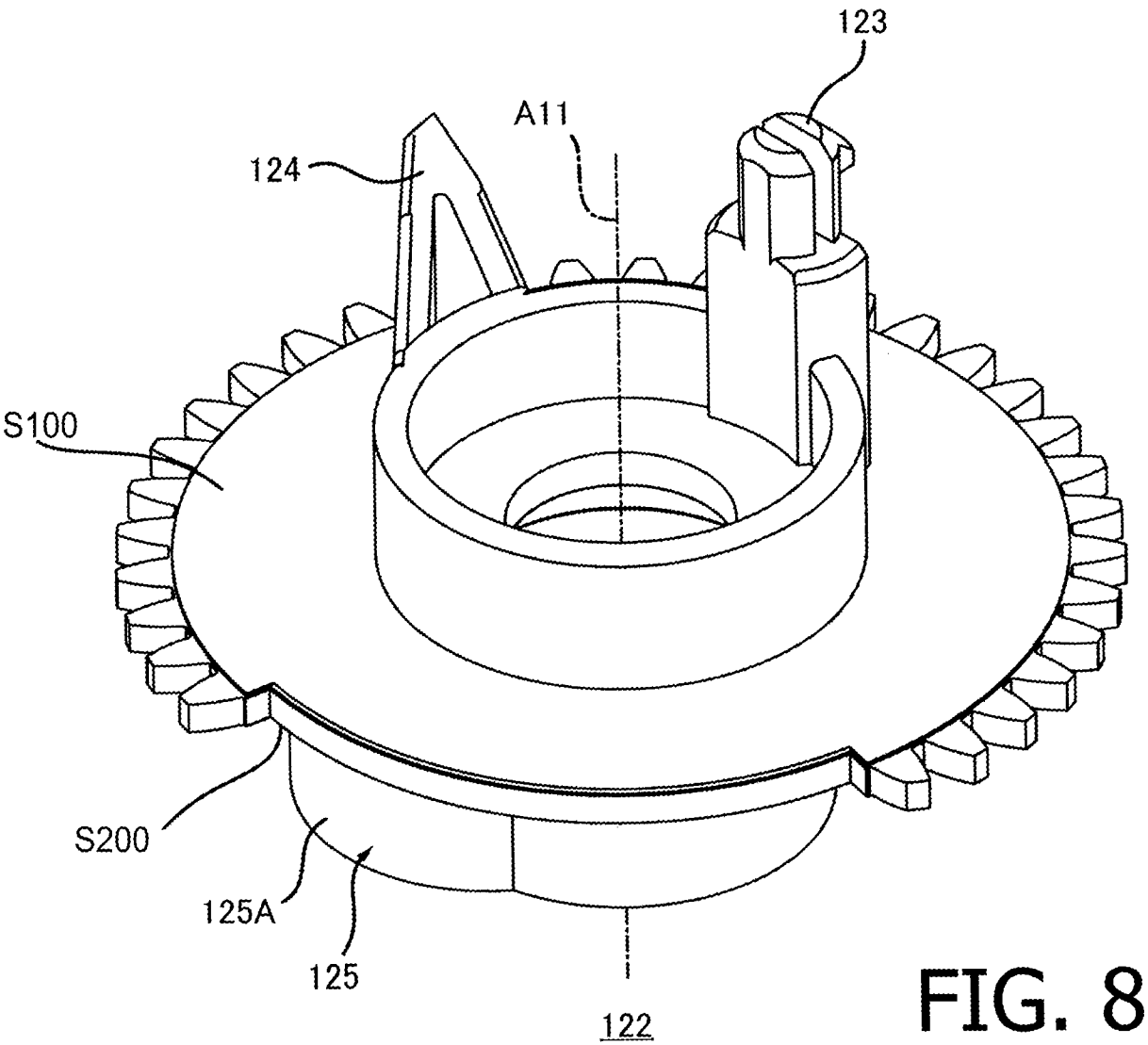
FIG. 8 is a perspective view of a sector gear of the interlocking mechanism shown in FIG. 5A.

As shown in FIG. 8, the sector gear 122 has one surface S100 and another surface S200 arranged in a direction in which the axis A11 extends. The sector gear 122 is supported by a particular shaft in the housing 2. The shaft extends along the axis A11.

2.2.3 Protrusion 123

Figure 9A:
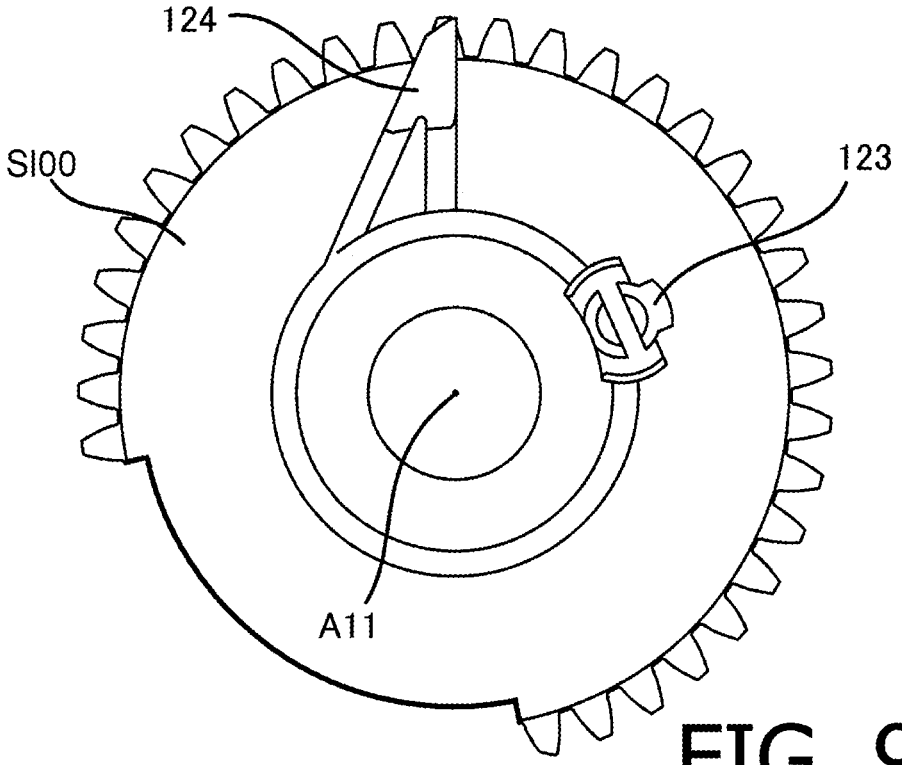
FIG. 9A is a plan view of a first surface of the sector gear shown in FIG. 8.

As shown in FIGS. 8 and 9A, the protrusion 123 is arranged on the one surface S100 of the sector gear 122. The protrusion 123 extends from the one surface S100 of the sector gear 122. The protrusion 123 may be attached to the one surface S100 of the sector gear 122. The protrusion 123 extends in the direction in which the axis A11 extends. The protrusion 123 is located at a position spaced from the axis A11 in the radial direction of the sector gear 122.

2.2.4 Projection 124

The protrusion 124 is arranged on the one surface S100 of the sector gear 122. The protrusion 124 extends from the one surface S100 of the sector gear 122. The protrusion 124 may be attached to the one surface S100 of the sector gear 122. The protrusion 124 extends in the direction in which the axis A11 extends. The protrusion 124 is arranged at a position spaced from the axis A11 in the radial direction of the sector gear 122. The protrusion 124 is arranged spaced from the protrusion 123.

2.2.5 Contact Member 125

As shown in FIGS. 5B and 6B, the contact member 125 is configured to be movable, together with the sector gear 122, between the first position (see FIG. 5B) and the second position (see FIG. 6B).

As shown in FIG. 5B, in a state where the sector gear 122 is located at the sector first position, the contact member 125 is located at the first position. In a state where the contact member 125 is located at the first position, the contact member 125 is located at a position space from the lever 13A of the sensor 13. In a case where the contact member 125 is located at the first position, the interlocking mechanism 12 is in the first state.

As shown in FIG. 6B, in a state where the sector gear 122 is located at the sector second position, the contact member 125 is located at the second position. In a state where the contact member 125 is located at the second position, the contact member 125 comes into contact with the lever 13A of the sensor 13. In a case where the contact member 125 is located at the second position, the interlocking mechanism 12 is in the second state.

Figure 9B:
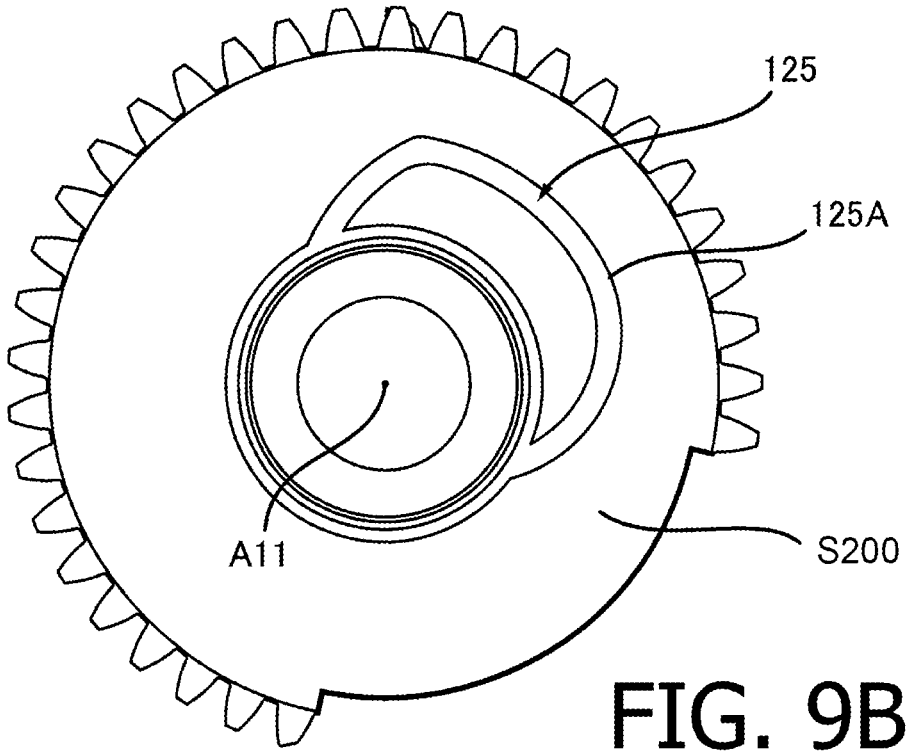
FIG. 9B is a plan view of a second surface of the sector gear shown in FIG. 8.

As shown in FIGS. 8 and 9B, the contact member 125 is located on the other surface S200 of the sector gear 122. The contact member 125 extends from the other surface S200 of the sector gear 122. The contact member 125 may be attached to the other surface S200 of the sector gear 122. The contact member 125 extends in the direction in which the shaft A11 extends. In the present embodiment, the contact member 125 is a cam. The contact member 125 is rotatable about the axis A11 between the first position (see FIG. 5B) and the second position (see FIG. 6B). The contact member 125 has a cam surface 125A. The cam surface 125A is arranged spaced from the axis A11. As shown in FIG. 6B, in a state where the contact member 125 is located at the second position, the cam surface 125A comes into contact with the lever 13A of the sensor 13. The contact member 125 may be a projection.

2.2.6 Spring 126

As shown in FIGS. 5A and 6A, the spring 126 is configured to move the contact member 125 toward the second position in the first position. In the present embodiment, the spring 126 is a pulling spring. One end of the spring 126 is attached to the protrusion 123. The other end of the spring 126 is attached to a particular projection formed in the housing 2. The spring 126 maybe a torsion spring configured to push the protrusion 123 such that the contact member moves from the first position to the second position.

2.2.7 Stopper 127

As shown in FIG. 5A, in a state where the cover 3 is located at the closed position, the stopper 127 stops the sector gear 122 from rotating from the sector first position to the sector second position.

Figure 10:
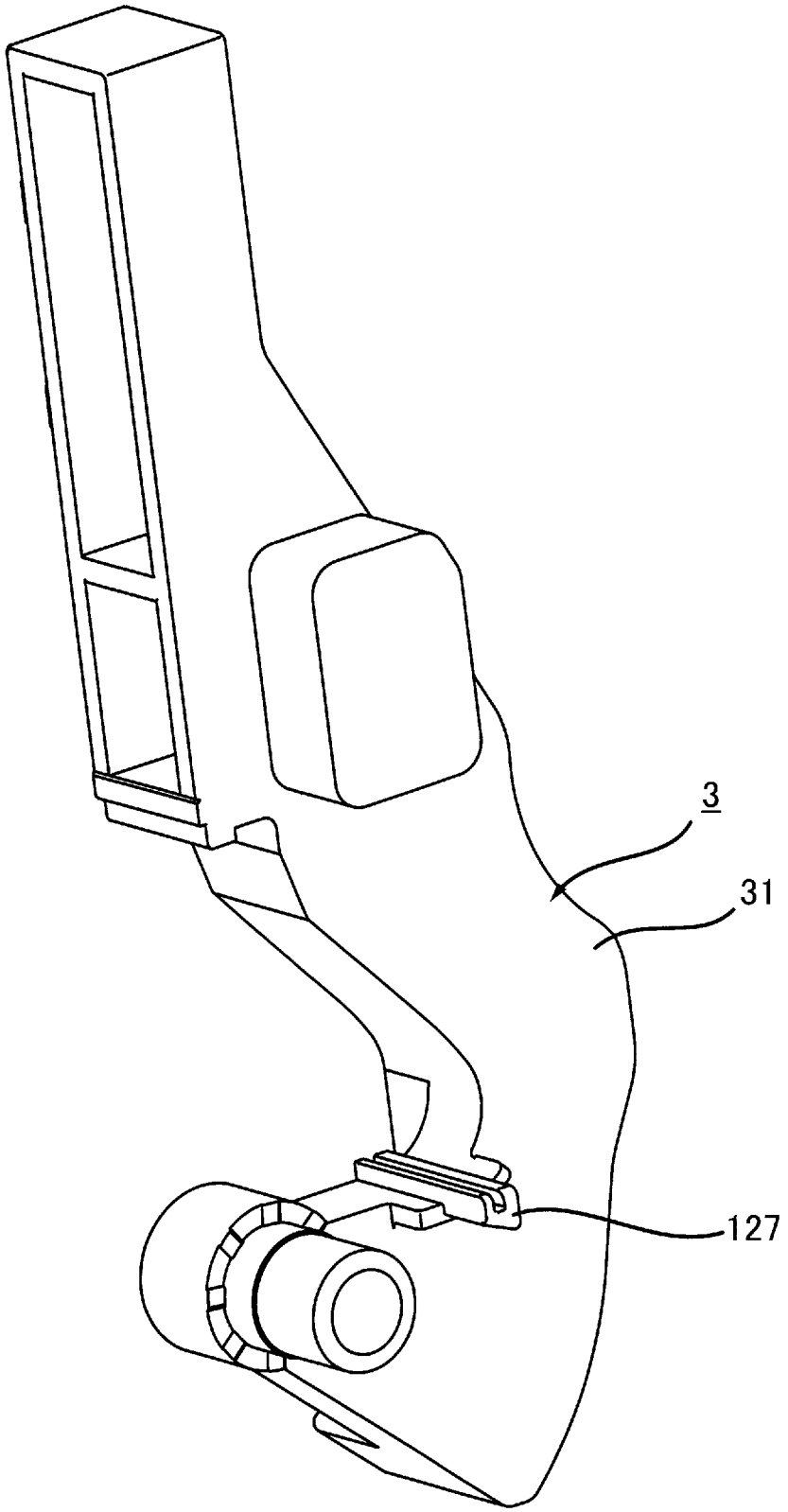
FIG. 10 is a perspective view of a stopper employed in the interlocking mechanism shown in FIG. 5A.
Figure 11:
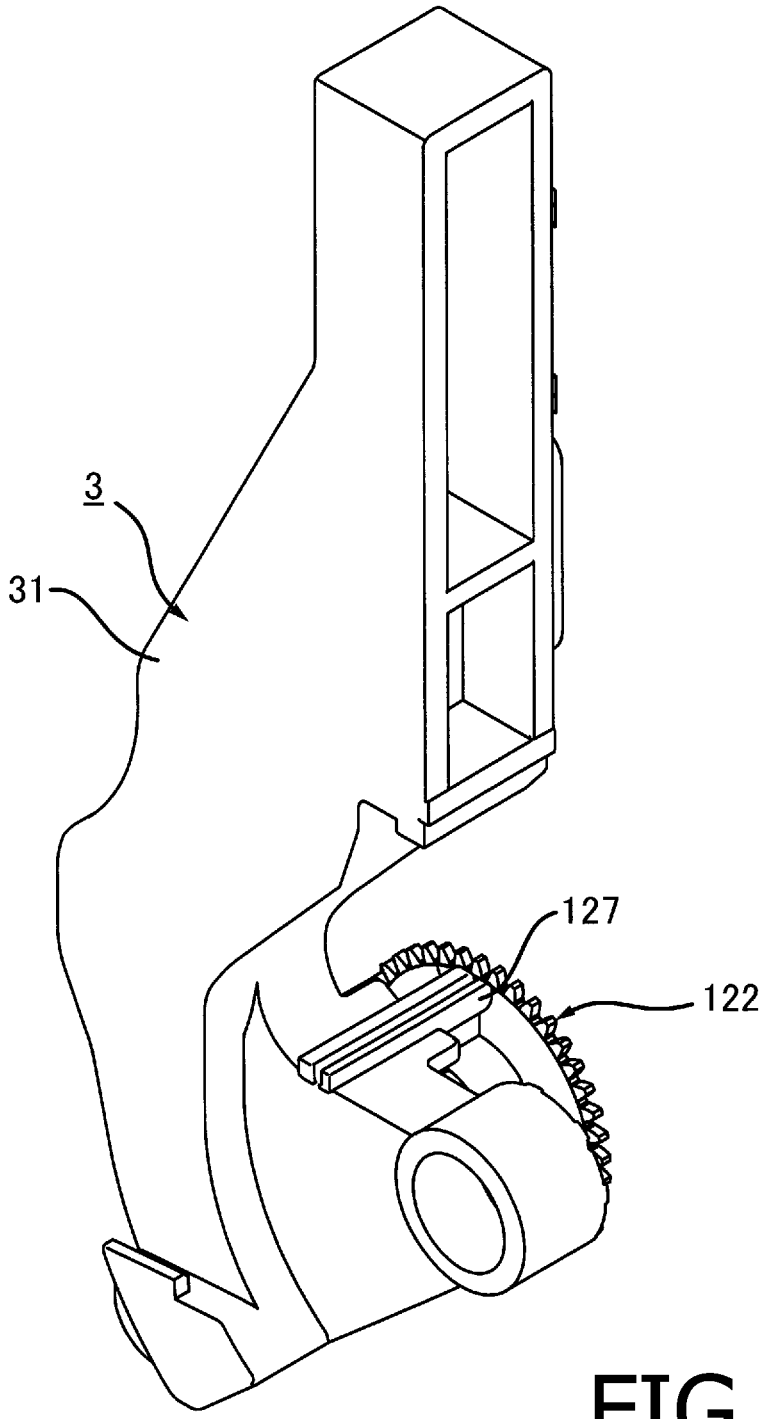
FIG. 11 shows a positional relationship between the stopper shown in FIG. 10 and the sector gear shown in FIG. 5A.

In detail, as shown in FIG. 10, the stopper 127 extends from the cover 3. In the present embodiment, the stopper 127 extends from a hinge 31 of the cover 3. The stopper 127 may be attached to the cover 3. As shown in FIG. 11, in a state where the cover 3 is located at the closed position, the stopper 127 extends from the cover 3 toward the sector gear 122. The stopper 127 extends in the direction in which the axis A11 (see FIG. 5A) extends.

As shown in FIG. 5A, in a state where the cover 3 is located at the closed position and the sector gear 122 is located at the sector first position, the stopper 127 contacts the protrusion 124. As a result, the stopper 127 stops the rotation of the sector gear 122 from the sector first position to the sector second position.

On the other hand, as shown in FIGS. 5A and 6A, in a case where the cover 3 moves from the closed position to the open position, the stopper 127 moves in association with the cover 3 to allow the sector gear 122 to rotate from the sector first position to the sector second position. In detail, in a case where the cover 3 is moved from the closed position to the open position, the stopper 127 moves in association with the cover 3 and moves away from the protrusion 124. As the stopper 127 moves away from the protrusion 124, the sector gear 122 becomes rotatable from the sector first position to the sector second position. In other words, the stopper 127 permits the sector gear 122 to rotate from the sector first position to the sector second position. In a case where the stopper 127 moves away from the protrusion 124, the sector gear 122 rotates from the sector first position to the sector second position by an elastic force of the spring 126.

It is noted that, as shown in FIGS. 6A and 7, in a case where the cover 3 moves from the open position to the closed position, the stopper 127 does not contact the protrusion 124 of the sector gear 122 since the sector gear 122 is located at the sector second position.

As shown in FIG. 7 and FIG. 5A, in a case where the sector gear 122 rotates from the sector second position to the sector first position by the power from the drive gear 121 in a state where the cover 3 in the closed position, the sector gear 122 is positioned in the sector first position as the protrusion 124 comes into contact with the stopper 127 after the sector gear 122 and the drive gear 121 are disengaged.

2.3 Sensor 3

As shown in FIG. 6B, in a state where the contact member 125 contacts the sensor 13, the sensor 13 detects that the interlocking mechanism 12 is in the second state.

In the present embodiment, the sensor 13 is a limit switch provided with a lever 13A. The lever 13A is configured to move between a lever first position (see FIG. 5B) and a lever second position (see FIG. 6B).

As shown in FIG. 5B, in a state where the contact member 125 is located at the first position, the lever 13A is not pressed by the contact member 125 and is located at the lever first position. In a state where the lever 13A is located at the lever first position, the sensor 13 does not detect that the interlocking mechanism 12 is in the second state.

On the other hand, as shown in FIG. 6B, in a state where the contact member 125 is located at the second position, the lever 13A is pressed by the contact member 125 and is located at the lever second position. In a state where the lever 13A is located at the lever second position, the sensor 13 detects that the interlocking mechanism 12 is in the second state.

It is noted that the sensor 13 is not necessarily be limited to a limit switch as long as the sensor 13 can detect that the interlocking mechanism 12 is in the second state. For example, the sensor 13 may be a photo interrupter. In a case where the sensor 13 is a photo interrupter, the interlocking mechanism 12 does not have to have the contact member 125. The photo interrupter may be configured to detect a shielding plate that moves in association with the sector gear 122, or may detect a notch or through hole formed on the sector gear 122.

2.4 Separation Mechanism 14

As shown in FIGS. 1 and 3, the separation mechanism 14 is configured to move the developing roller 71Y from the contact position (see FIG. 1) to the separation position (see FIG. 3).

Figure 12A:
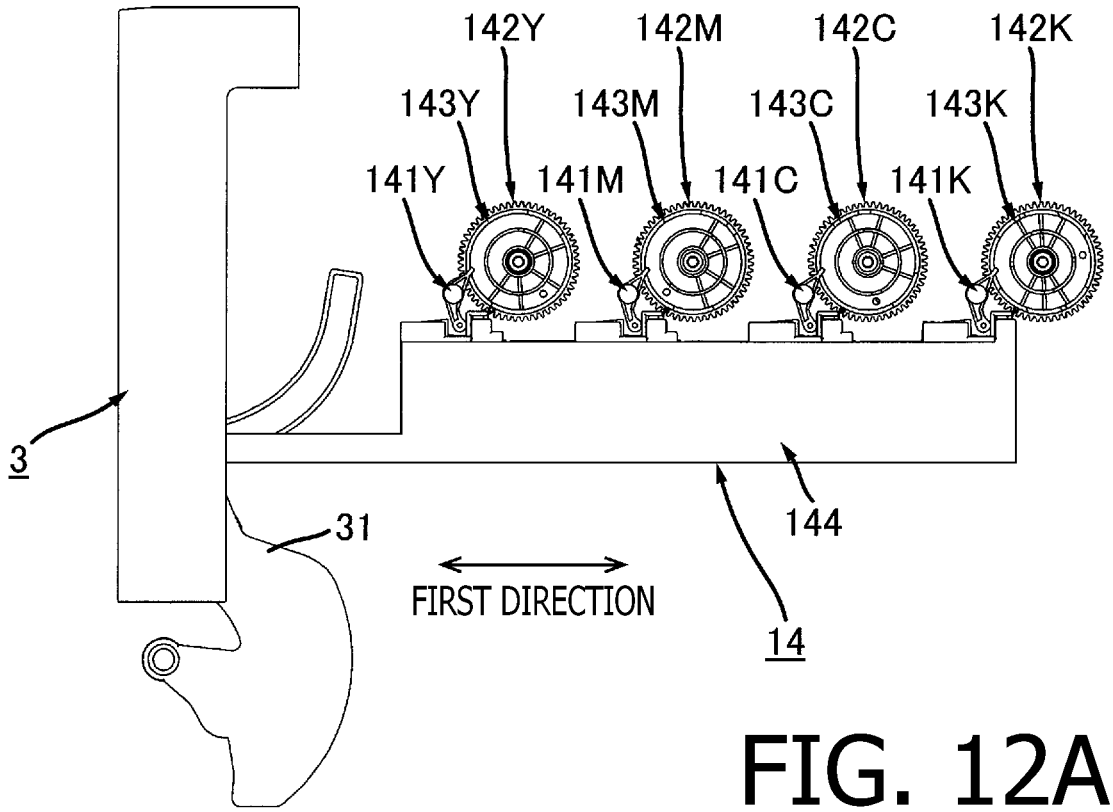
FIG. 12A shows the separation mechanism shown in FIG. 4, in a state where the cover is located at the closed position and the cam follower is located at a first rotational position.

In detail, as shown in FIG. 12A, the separation mechanism 14 has a plurality of cam followers 141Y, 141M, 141C and 141K, a plurality of gears 142Y, 142M, 142C and 142K, a plurality of cams 143Y, 143M, 143C and 143K, and a cam 144.

Each of the cam followers 141M, 141C and 141K has the same structure as the cam follower 141Y, each of the gears 142M, 142C and 142K has the same structure as the gear 142Y, and each of the cams 143M, 143C and 143K has the same structure as the cam 143Y. Therefore, in the following description, only the cam follower 141Y, the gear 142Y and the cam 143Y will be described, and description on the cam followers 141M, 141C, 141K, the gears 142M, 142C, 142K, and the cams 143M, 143C, 143K will be omitted.

2.4.1 Cam Followers 141Y, 141M, 141C and 141K

The cam follower 141Y is a member for releasing the developing roller 71Y (see FIG. 3) from the photosensitive drum 51Y (see FIG. 3).

Figure 13A:
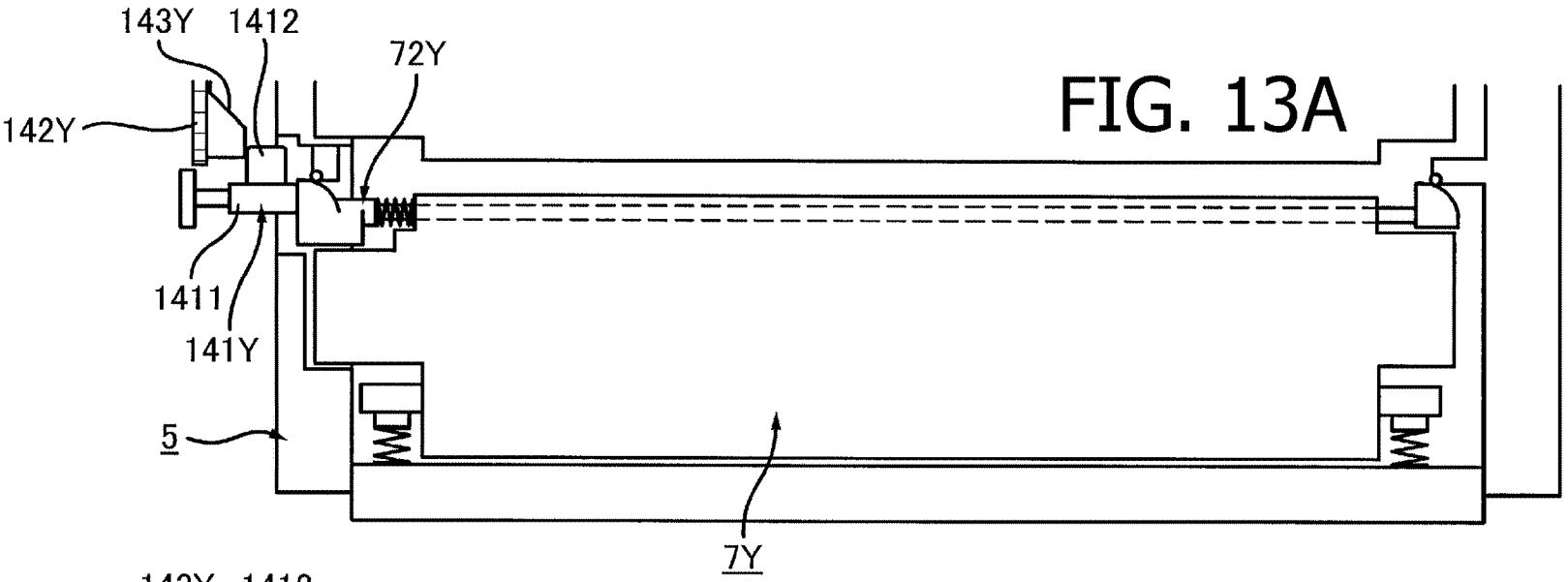
FIG. 13A shows the separation mechanism shown in FIG. 12A, in a state where the cam follower located at the first rotational position is located at a pressing position, and a developer cartridge is located at a position where the developing roller is separated from the photosensitive drum.
Figure 13B:
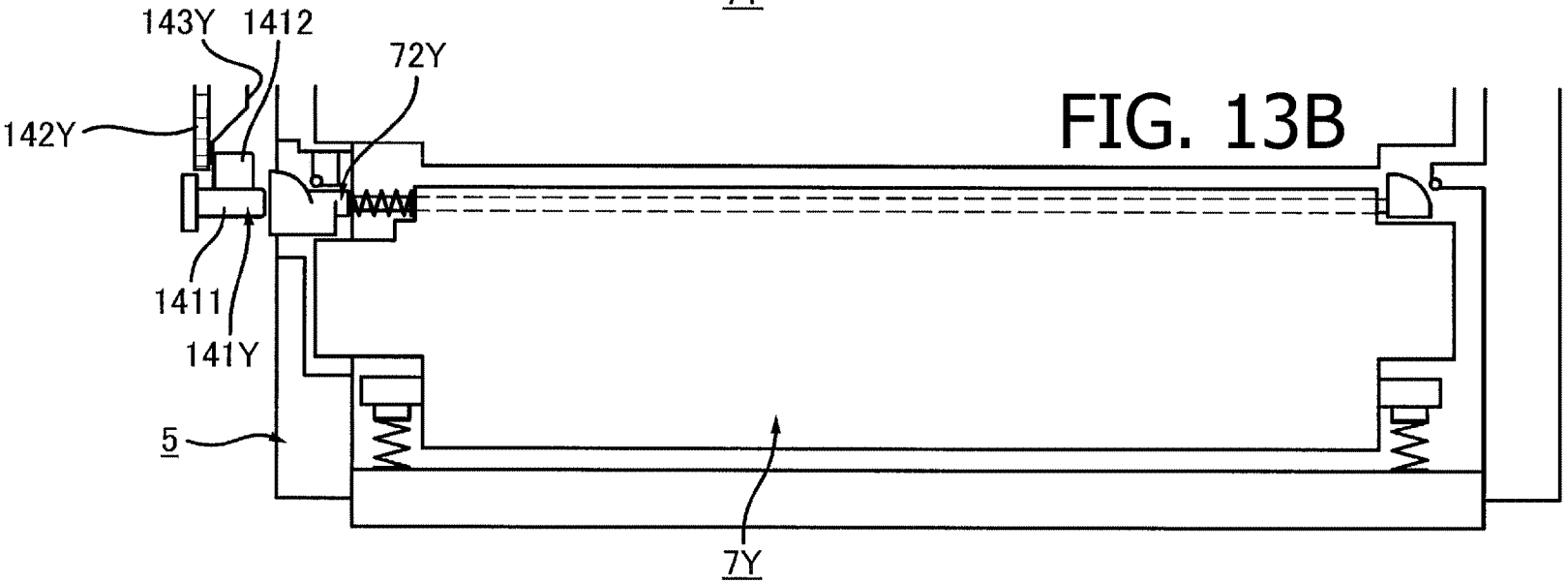
FIG. 13B shows the separation mechanism shown in FIG. 12A, in a state where the cam follower located at the first rotational position is located in a pressure release position and the developer cartridge is located at a position where the developing roller is in contact with the photosensitive drum.

As shown in FIGS. 13A and 13B, the cam follower 141Y is configured to be movable between a pressing position (see FIG. 13A) and a pressure release position (see FIG. 13B) in the second direction. The cam follower 141Y is configured to be pulled toward the pressure release position by a tension spring not shown in the figure.

As shown in FIG. 13A, in a state where the cam follower 141Y is located at the pressing position, the developing roller 71Y (see FIG. 3) is located at the separation position.

In detail, in the present embodiment, the developer cartridge 7Y has a separation member 72Y. The drum unit 5 may have the separation member 72Y. The separating member 72Y is a member configured to move the developer cartridge 7Y in a direction in which the developing roller 71Y is spaced from the photosensitive drum 51Y. When the cam follower 141Y is located at the pressing position, the cam follower 141Y presses the separation member 72Y. In a state where the cam follower 141Y presses the separating member 72Y, the separating member 72Y make the developer cartridge 7Y be located at a position where the developing roller 71Y is spaced from the photosensitive drum 51Y. As a result, in a state where the cam follower 141Y is located at the pressing position, the developing roller 71Y (see FIG. 3) is located at the separation position.

On the other hand, in a state where the cam follower 141Y is at the pressure release position, the developing roller 71Y (see FIG. 1) is located at the contact position as shown in FIG. 13B.

In detail, in a state where the cam follower 141Y is located at the pressure release position, the cam follower 141Y is spaced from the separation member 72Y and releases the pressure on the separation member 72Y. Then, the separating member 72Y permits the developer cartridge 7Y to move to the position where the developing roller 71Y contacts the photosensitive drum 51Y. As a result, in a state where the cam follower 141Y is located at the pressure release position, the developing roller 71Y (see FIG. 1) is located at the contact position.

Figure 14A:
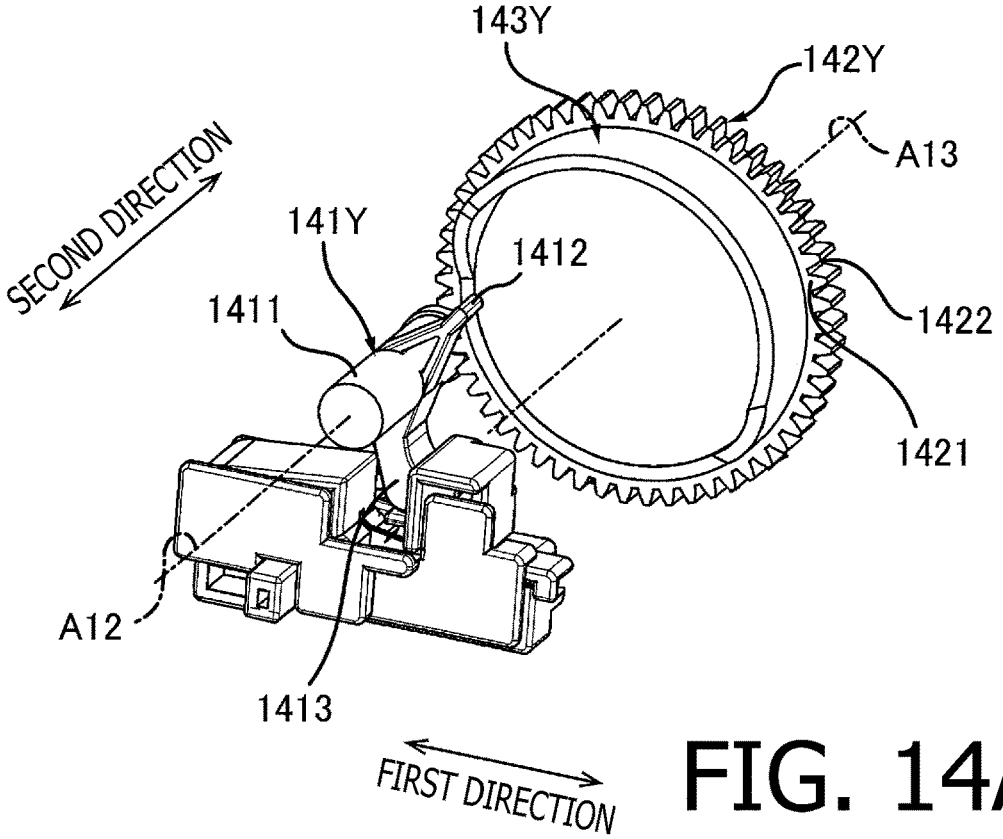
FIG. 14A is a perspective view of the separation mechanism shown in FIG. 12A.
Figure 14B:
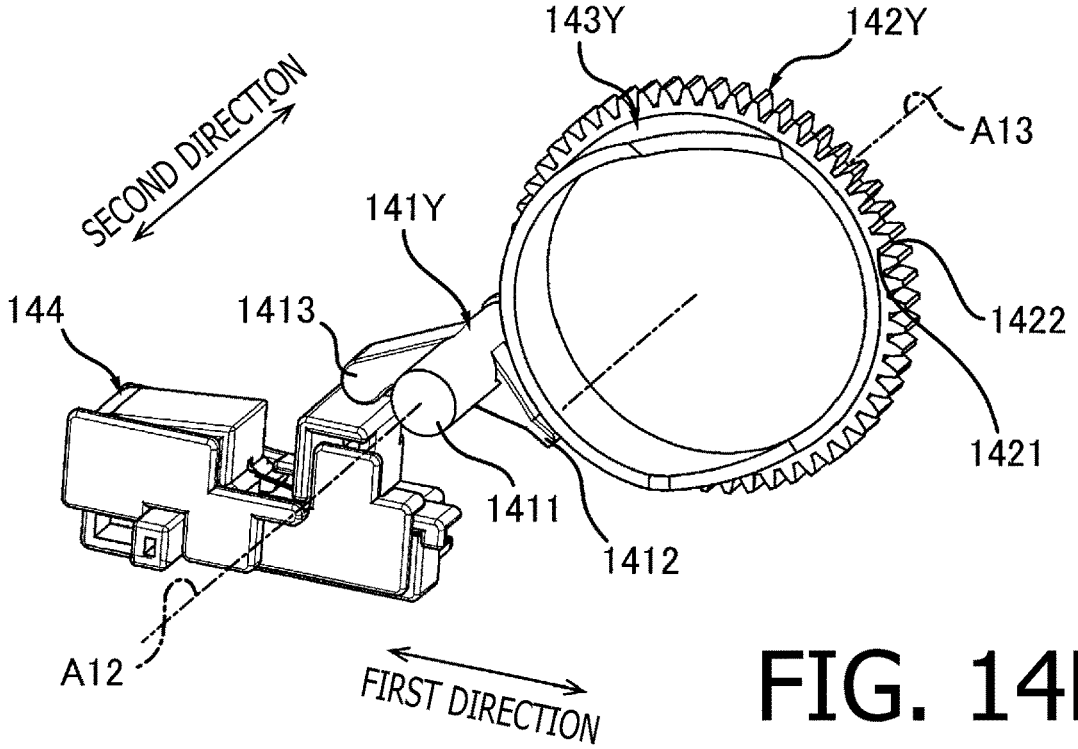
FIG. 14B is a perspective view of the separation mechanism shown in FIG. 12B.

As shown in FIGS. 14A and 14B, the cam follower 141Y is configured to be rotatable about the axis A12, between the first rotational position (see FIG. 14A) and the second rotational position (see FIG. 14B). The axis A12 extends in the second direction.

As shown in FIG. 14A, in a state where the cam follower 141Y is located at the first rotational position, the cam follower 141Y is capable of contacting the cam 143Y.

As shown in FIG. 14B, in a state where the cam follower 141Y is located at the second rotational position, the cam follower 141Y is unable to contact the cam 143Y. Therefore, in a state where the cam follower 141Y is located at the second rotational position, the cam follower 141Y is maintained to stay at the pressure release position regardless of the position of the cam 143Y.

As shown in FIG. 14A, the cam follower 141Y has a shaft 1411, a protrusion 1412, and a protrusion 1413.

The shaft 1411 is configured to extend in the second direction along the axis A12. In a state where the cam follower 141Y is located at the pressing position, the shaft 1411 presses the separation member 72Y.

The protrusion 1412 extends from the shaft 1411 in the radial direction of the shaft 1411.

The protrusion 1413 extends from the shaft 1411 in the radial direction of the shaft 1411. The protrusion 1413 is located at a position spaced from the protrusion 1412.

2.4.2 Gear 142Y

As shown in FIG. 14A, the gear 142Y is configured to be rotatable about the axis A13, which extends in the second direction. The axis A13 is located at a position spaced from the axis A12. The gear 142Y has one surface 1421 and the other surface 1422 in the second direction.

2.4.3 Cam 143Y

As shown in FIG. 14A, when the cam 143Y rotates in a state where the cam follower 141Y is located at the first rotational position, the cam 143Y presses the protrusion 1412 of the cam follower 141Y in the second direction. As a result, the cam 143Y moves the cam follower 141Y from the pressure release position (see FIG. 13B) to the pressing position (see FIG. 13A). In a state where the cam 143Y is separated from the protrusion 1412 of the cam follower 141Y, the cam 143Y allows the cam follower 141Y to move from the pressing position (see FIG. 13A) to the pressure release position (see FIG. 13B).

The cam 143Y is arranged on the one surface 1421 of the gear 142Y. The cam 143Y extends from the one surface 1421 of the gear 142Y. The cam 143Y may be attached to the one surface 1421 of the gear 142Y. The cam 143Y is rotatable about axis A13 in association with the gear 142Y. The cam 143Y extends in the second direction and in the direction of rotation of the gear 142Y.

2.4.3 Cam 144

Figure 12B:
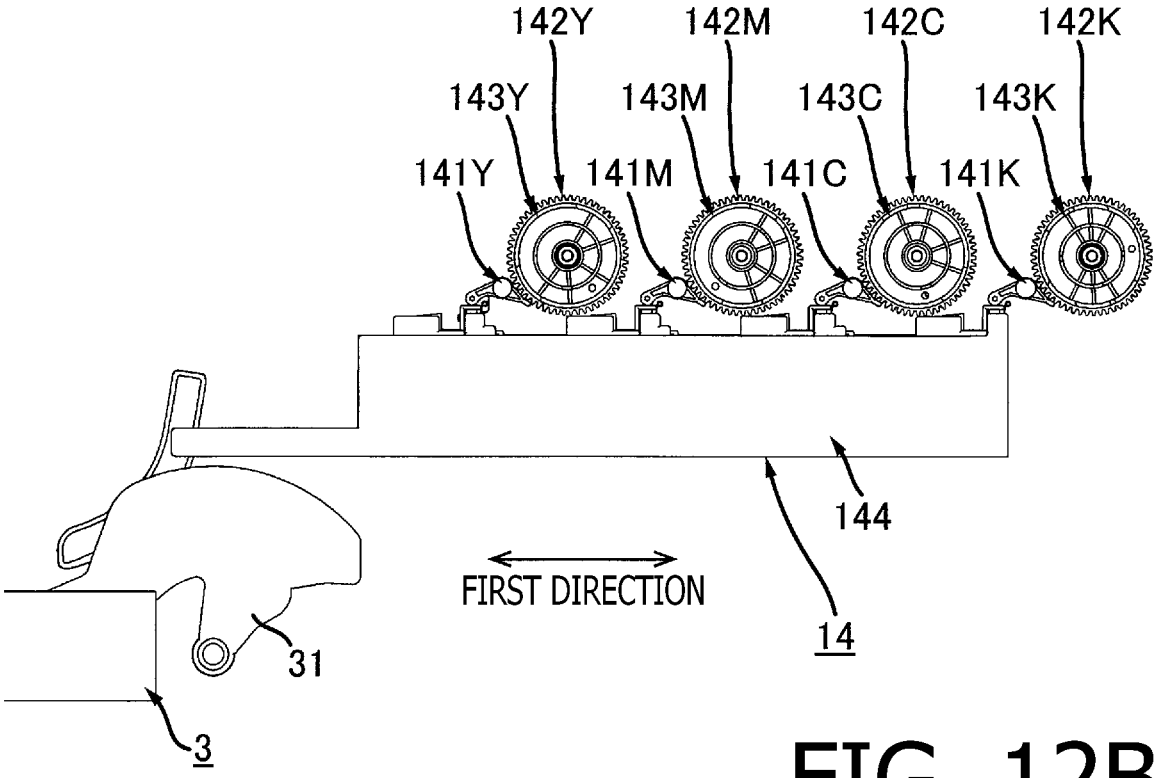
FIG. 12B shows the separation mechanism shown in FIG. 12A, in a state where the cover is located at the open position and the cam follower is located at a second rotational position.

As shown in FIGS. 12A and 12B, the cam 144 is configured to move the cam follower 141Y from the first rotational position to the second rotational position in association with the movement of the cover 3 from the closed position to the open position. As described above, in a state where the cam follower 141Y is located at the second rotational position, the cam follower 141Y is located at the pressure release position. Therefore, the developing roller 71Y (see FIG. 3) is located at the contact position. That is, the separation mechanism 14 permits the movement of the developing roller 71Y from the separation position to the contact position in association with the movement of the cover 3 from the closed position to the open position.

On the other hand, the cam 144 is configured to move the cam follower 141Y from the second rotation position to the first rotation position in association with the movement of the cover 3 from the open position to the closed position.

The cam 144 is connected to the hinge 31 of the cover 3 via a link. The cam 144 is movable in the first direction.

2.5 Drum Cleaners 15Y, 15M, 15C and 15K

Each of the drum cleaners 15M, 15C and 15K has the same structure as the drum cleaner 15Y. Therefore, in the following description, only the drum cleaner 15Y will be described, and the descriptions on the drum cleaners 15M, 15C and 15K will be omitted.

As shown in FIG. 1, the drum cleaner 15Y has a drum cleaning roller 151Y. The drum cleaning roller 151Y is configured to clean the photosensitive drum 51Y. In other words, the drum cleaner 15Y is configured to clean the photosensitive drum 51Y.

2.6 Belt Cleaner 16

The belt cleaner 16 has a belt cleaning roller 161. The belt cleaning roller 161 is configured to clean the belt 81. In other words, the belt cleaner 16 is configured to clean the belt 81.

2.7 Controller 17

As shown in FIG. 4, the controller 17 is electrically connected to the sensor 13. The controller 17 is configured to control the operation of the interlocking mechanism 12, the separation mechanism 14, the plurality of drum cleaners 15Y, 15M, 15C and 15K, the belt cleaner 16, and the fixing device 9.

Concretely, the controller 17 is a control circuit board configured to control the operation of the image forming apparatus 1. The controller 17 is equipped with a processor 171 and a memory 172. In other words, the image forming apparatus 1 has a memory 172. The processor 171 includes, for example, a CPU (central processing unit). The memory 172 includes a non-volatile memory. The controller 17 may also have an ASIC (application-specific integrated circuit).

When the controller 17 locate the developing roller 71Y at the contact position, the controller 17 writes, in the memory 172, information indicating that the developing roller 71Y is to be located at the contact position. On the other hand, in a case where the controller 17 locates the developing roller 71Y at the separation position, the controller 17 writes, in the memory 172, information indicating that the developing roller 71Y is in the separation position.

3. Control of Image Forming Apparatus 1

Next, referring to FIG. 15 and FIG. 16, the control of the image forming apparatus 1 will be described.

Figure 15:
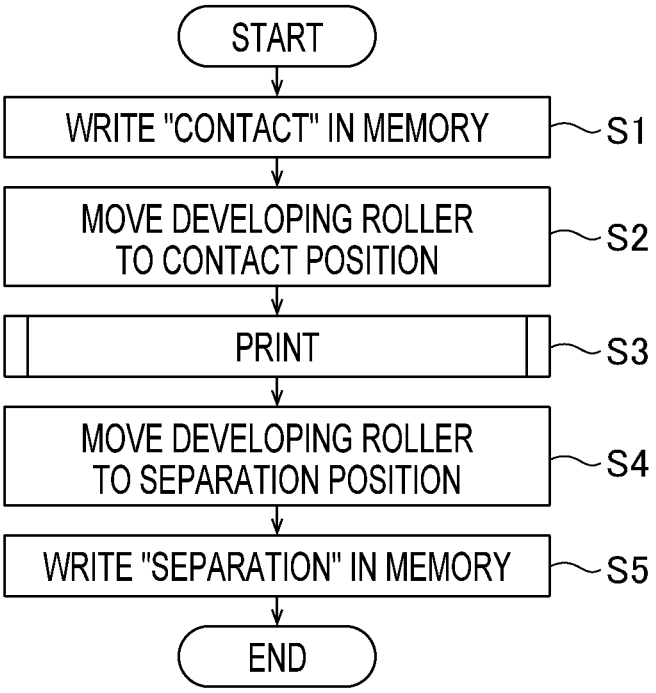
FIG. 15 is a flowchart illustrating a control of the image forming apparatus.

As shown in FIG. 15, in a state where the power switch 11 in the on state, the controller 17 writes the information that the developing roller 71Y is in the contact position to the memory 172 (S1) before starting a printing process (S3), and activates the separation mechanism 14 to locate the developing roller 71Y at the contact position (S2).

After the printing process (S3) is completed, the controller 17 operates the separation mechanism 14 to locate the developing roller 71Y at the separation position (S4), and writes the information that the developing roller 71Y is located at the separation position in the memory 172 (S5).

That is, in a case where the state of the power switch 11 is changed from the on state to the off state, and power is no longer supplied to the controller 17, the developing roller 71Y is located at the separation position, and in the memory 172, it has been written that the developing roller 71Y is located at the separation position.

Figure 16:
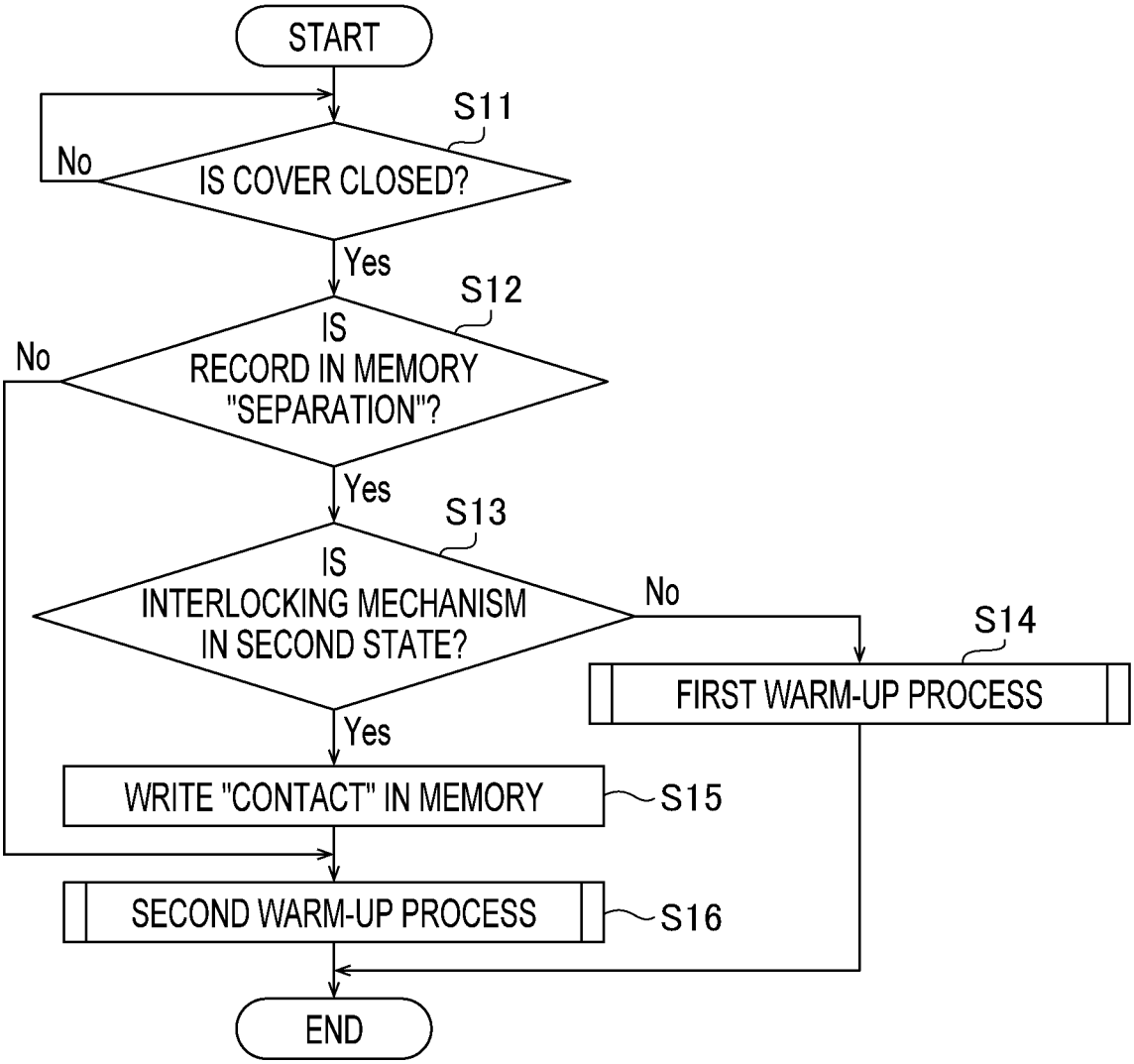
FIG. 16 is a flowchart illustrating, in association with the flowchart shown in FIG. 15, the control of the image forming apparatus.

Next, in a case where the state of the power switch 11 is changed from the off state to the on state, and power supply to the controller 17 is started, as shown in FIG. 16, in a case where the cover 3 is located at the closed position (S11: YES), the controller 17 refers to the memory 172 to determine whether it is recorded that the developing roller 71Y is located at the separation position (S12).

In a case where it is recorded in the memory 172 that the developing roller 71Y is in the separation position (S12: YES), the controller 17 determines whether the sensor 13 detects that the interlocking mechanism 12 is in the second state (S13).

In a case where it is recorded in the memory 172 that the developing roller 71Y is located at the contact position when power supply to the controller 17 is started (S12: NO), the controller 17 performs a second warm-up process described below (S16) without determining whether or not the sensor 13 detects that the interlocking mechanism 12 is in the second state.

3.1 First Warm-Up Process

In a case where power supply to the controller 17 is started and the sensor 13 does not detect that the interlocking mechanism 12 is in the second state (S13: NO), the controller 17 performs a first warm-up process (S14). It is noted that "a case where the sensor 13 does not detect that the interlocking mechanism 12 is in the second state" means, in other words, a case where the cover 3 has not been moved from the closed position to the open position while the power is not supplied to the controller 17. In such a case, the developing roller 71Y (see FIG. 3) is located at the separation position, and the information that the developing roller 71Y is located at the separation position is recorded in the memory 172.

In the first warm-up process (S14), the controller 17 does not rotate the cam 143Y of the separation mechanism 14 while the developing roller 71Y is located at the separation position, as shown in FIG. 12B. As a result, the cam follower 141Y is kept at the pressing position and the developing roller 71Y is kept at the separating position.

That is, in the first warm-up process (S14), the controller 17 causes the separation mechanism 14 to make the developing roller 71Y stay at the separation position. In other words, in a case where the sensor 13 does not detect that the interlocking mechanism 12 is in the second state when power supply to the controller 17 is started, the separating mechanism 14 makes the developing roller 71Y located at the separation position remain at the separation position.

Further, in the first warm-up process (S14), the controller 17 does not rotate the photosensitive drums 51Y, 51M, 51C and 51K (see FIG. 3), the drum cleaning rollers 151Y, 151M, 151C and 151K (see FIG. 3), and the belt cleaning rollers 161 (see FIG. 3).

That is, in the first warm-up process (S14), the controller 17 does not allow the drum cleaner 15Y to clean the photosensitive drum 51Y, does not allow the drum cleaner 15M to clean the photosensitive drum 51M, does not allow the drum cleaner 15C to clean the photosensitive drum 51C, and does not allow the drum cleaner 15K to clean the photosensitive drum 51K. In other words, in a case where the sensor 13 does not detect that the interlocking mechanism 12 is in the second state when power supply to the controller 17 is started, the drum cleaner 15Y does not clean the photosensitive drum 51Y, the drum cleaner 15M does not clean the photosensitive drum 51M, the drum cleaner 15C does not clean the photosensitive drum 51C and the drum cleaner 15K does not clean the photosensitive drum 51K.

In the first warm-up process (S14), the controller 17 does not allow the belt cleaner 16 to clean the belt 81. In other words, in a case where the sensor 13 does not detect that the interlocking mechanism 12 is in the second state when power supply to the controller 17 is started, the belt cleaner 16 does not clean the belt 81.

In the first warm-up process (S14), the controller 17 raises the temperature of the fixing device 9 to a particular target temperature.

3.2 Second Warm-Up Process

On the other hand, in a case where the sensor 13 detects that the interlocking mechanism 12 is in the second state (S13: YES) when power supply to the controller 17 is started, the controller 17 performs a second warm-up process (S16). It is noted that "a case where the sensor 13 detects that the interlocking mechanism 12 is in the second state" means, in other words, a case where the cover 3 moves from the closed position to the open position while the power is not supplied to the controller 17. In such a case, the developing roller 71Y (see FIG. 1) is located at the contact position. In contrast, the fact that the developing roller 71Y is located at the separation position is recorded in the memory 172.

Therefore, in a case where the sensor 13 detects that the interlocking mechanism 12 is in the second state (S13: YES) when power supply to the controller 17 is started, the controller 17 writes to the memory 172 that the developing roller 71Y is located at the contact position (S15) and performs the second warm-up process (S16).

In the second warm-up process (S16), the controller 17 rotates the cam 143Y of the separation mechanism 14 in a state where the cam follower 141Y is located at the first rotation position as shown in FIG. 14A. Then, the cam follower 141Y moves from the pressure release position (see FIG. 13B) to the pressing position (see FIG. 13A), and the developing roller 71Y moves from the contact position (see FIG. 1) to the separation position (see FIG. 3).

It is noted that, in the second warm-up process (S16), the controller 17 causes the separation mechanism 14 to move the developing roller 71Y located at the contact position to the separation position. In other words, in a case where the sensor 13 detects that the interlocking mechanism 12 is in the second state when power supply to the controller 17 is started, the separation mechanism 14 moves the developing roller 71Y, which is located at the contact position, to the separation position.

Further, in the second warm-up process (S16), the controller 17 rotates the photosensitive drums 51Y, 51M, 51C and 51K (see FIG. 1), the drum cleaning rollers 151Y, 151M, 151C and 151K (see FIG. 1), and the belt cleaning roller 161 (see FIG. 1).

That is, in the second warm-up process (S16), the controller 17 causes the drum cleaner 15Y to clean the photosensitive drum 51Y, the drum cleaner 15M to clean the photosensitive drum 51M, the drum cleaner 15C to clean the photosensitive drum 51C, and the drum cleaner 15K to clean the photosensitive drum 51K. In other words, in a case where the sensor 13 detects that the interlocking mechanism 12 is in the second state when power supply to the controller 17 is started, the drum cleaner 15Y cleans the photosensitive drum 51Y, the drum cleaner 15M cleans the photosensitive drum 51M, the drum cleaner 15C cleans the photosensitive drum 51C, and the drum cleaner 15K cleans the photosensitive drum 51K.

In the second warm-up process (S16), the controller 17 causes the belt cleaner 16 to clean the belt. In other words, in a case where the sensor 13 detects that the interlocking mechanism 12 is located at the second state when power supply to the controller 17 is started, the belt cleaner 16 cleans the belt 81.

Also, in the second warm-up process (S16), the controller 17 raises the temperature of the fixing device 9 to a particular target temperature.

4. Effects (1) According to the image forming apparatus 1, as shown in FIGS. 12A and 12B, the cam follower 141Y of the separation mechanism 14 moves from the first rotational position (see FIG. 12A) to the second rotational position (see FIG. 12B) in association with the movement of the cover 3 from the closed position (see FIG. 12A) to the open position (see FIG. 12B). At the second rotational position, the cam follower 141Y releases the pressure of the developer cartridge 7Y on the separating member 72Y (see FIG. 13B). The release of the pressure on the separation member 72Y of the developer cartridge 7Y causes the developing roller 71Y to move from the separation position (see FIG. 3) to the contact position (see FIG. 1).

That is, the separation mechanism 14 allows the developer roller 71Y to move from the separation position to the contact position in association with the movement of the cover 3 from the closed position to the open position. As a result, when the cover 3 is moved from the closed position to the open position while no power is supplied to the controller 17, the developing roller 71Y moves from the separation position to the contact position.

As shown in FIG. 5A and FIG. 6A, in a case where the cover 3 moves from the closed position to the open position while no power is supplied to the controller 17, the state of the interlocking mechanism 12 switches from the first state (see FIG. 5A) to the second state (see FIG. 6A). Thereafter, as shown in FIG. 6A and FIG. 7, the interlocking mechanism 12 remains in the second state even though the cover 3 located at the open position moves to the closed position.

Therefore, in a case where the cover 3 is moved from the closed position to the open position while no power is supplied to the controller 17, the history of the cover 3 moving from the closed position to the open position will remain in the interlocking mechanism 12.

Then, as shown in FIG. 16, in a case where the sensor 13 detects that the interlocking mechanism 12 is in the second state (S13: YES) when power supply to the controller 17 is started, in the second warm-up process (S16), the controller 17 causes the separation mechanism 14 to move the developing roller 71Y, which is located at the contact position (see FIG. 1), to the separation position (see FIG. 3).

On the other hand, in a case where the sensor 13 does not detect that the interlocking mechanism 12 is in the second state (S13: NO) when power supply to the controller 17 is started, the controller 17 causes, in the first warm-up process (S14), the separating mechanism 14 to keep the developing roller 71Y, which is located at the separation position, at the contact position without moving the same to the contact position.

Accordingly, unnecessary contact between the developing roller 71Y and the photosensitive drum 51Y can be reduced.

(2) According to the image forming apparatus 1, in a case where the cover 3 is moved from the closed position (see FIG. 1) to the open position (see FIG. 2) while the power is not supplied to the controller 17, foreign objects from outside are likely to enter the housing 2 due to the cover 3 being located at the open position.

Therefore, as shown in FIG. 16, in a case where the sensor 13 detects the interlocking mechanism 12 is in the second state (S13: YES) when power supply to the controller 17 is started, the controller 17 causes, in the second warm-up process (S16), the belt cleaner 16 (see FIG. 1) to clean the belt 81 (see FIG. 1). As a result, even though foreign objects that have entered the housing 2 adhere to the belt 81, the foreign objects can be removed.

On the other hand, in a case where the cover 3 is not moved from the closed position to the open position while no power is supplied to the controller 17, there is little possibility of foreign objects from outside entering the housing 2.

Therefore, in a case where the sensor 13 does not detect that the interlocking mechanism 12 is in the second state (S13: NO) when power supply to the controller 17 is started, the controller 17 does not cause, in the first warm-up process (S14), the belt cleaner 16 to clean the belt 81. This can reduce unnecessary belt cleaning.

(3) According to the image forming apparatus 1, in a case where the sensor 13 detects that the interlocking mechanism 12 is in the second state (S13: YES) when power supply to the controller 17 is started, the controller 17 causes, in the second warm-up process (S16), the drum cleaner 15Y to clean the photosensitive drum 51Y. (S13: YES), the controller 17 causes the drum cleaner 15Y to clean the photosensitive drum 51Y in the second warm-up process (S16). In this way, even though the foreign objects entering the housing 2 and adhere to the photosensitive drum 51Y, the foreign objects can be removed.

On the other hand, in a case where the sensor 13 does not detect that the interlocking mechanism 12 is in the second state (S13: NO) when power supply to the controller 17 is started, the controller 17 does not cause the drum cleaner 15Y to clean the photosensitive drum 51Y in the first warm-up process (S14). This can reduce unnecessary drum cleaning.

What is claimed is:

1. An image forming apparatus, comprising:

a housing formed with an opening;

a cover configured to be movable between a closed position at which the cover closes the opening and an open position at which the cover uncovers the opening;

a photosensitive drum;

a developing roller movable between a contact position at which the developing roller contacts the photosensitive drum and a separation position at which the developing roller is spaced from the photosensitive drum;

a separation mechanism configured to move the developing roller from the contact position to the separation position, the separation mechanism allowing movement of the developing roller from the separation position to the contact position in association with a movement of the cover from the closed position to the open position;

a controller configured to control the separation mechanism to move the developing roller between the separation position and the contact position;

an interlocking mechanism configured to change a state from a first state to a second state in association with the movement of the cover from the closed position to the open position when the cover moves from the closed position to the open position while no power is supplied is to the controller, and wherein the interlocking mechanism maintains the second state without associating with a movement of the cover from the open position to the closed position when the cover moves from the open position to the closed position while no power is supplied to the controller; and a sensor configured to detect whether the interlocking mechanism is in the second state, wherein the separation mechanism is configured to when the sensor does not detect that the interlocking mechanism is in the second state when power supply to the controller is started, keep the developing roller located at the separation position at the separation position, and when the sensor detects that the interlocking mechanism is in the second state when power supply to the controller is started, move the developing roller located at the contact position to the separation position.

2. The image forming apparatus according to claim 1, wherein the interlocking mechanism further comprises a contact member movable between a first position at which the contact member is located at a position spaced from the sensor and a second position at which the contact member comes into contact with the sensor, wherein, when the contact member is located at the first position, the interlocking mechanism is in the first state, and wherein, when the contact member is located at the second position, the interlocking mechanism is in the second state.

3. The image forming apparatus according to claim 2, wherein the interlocking mechanism further comprises a spring configured to move the contact member located at the first position toward the second position.

4. The image forming apparatus according to claim 3, wherein the contact member comprises a cam configured to rotate between the first position and the second position, and wherein the interlocking mechanism further comprises a drive gear configured to receive a power and rotate, and a sector gear configured to rotate together with the contact member between a sector first position and a sector second position, the contact member being located at the first position when the sector gear is located at the sector first position, the contact member being located at the second position when the sector gear is located at the sector second position, the sector gear not meshing with the drive gear when the sector gear being located at the sector first position, the sector gear meshing with the drive gear between the sector second position and the sector first position.

5. The image forming apparatus according to claim 4, wherein the interlocking mechanism further comprises a stopper configured to stop rotation of the sector gear from the first position to the second position in a state where the cover is located at the closed position, the stopper moving in association with movement of the cover from the closed position to the open position to allow a rotation of the sector gear from the sector first position to the sector second position.

6. The image forming apparatus according to claim 1, further comprising:

a transfer device having a belt configured to contact the photosensitive drum and configured to transfer toner on the photosensitive drum onto a sheet; and a belt cleaner configured to clean the belt, wherein the belt cleaner is configured to not clean the belt when the sensor does not detect that the interlocking mechanism is in the second state when power is start supplying to the controller, and clean the belt when the sensor detects that the interlocking mechanism is in the second state when power is start supplying to the controller.

7. The image forming apparatus according to claim 1, further comprising a drum unit having the photosensitive drum, the drum unit being movable, with the cover being located at the open position, between an inner position defined inside the housing and an outer position defined outside the housing through the opening.

8. The image forming apparatus according to claim 1, further comprising a drum cleaner configured to clean the photosensitive drum, wherein the drum cleaner is configured to:

not clean the photosensitive drum when the sensor does not detect that the interlocking mechanism is in the second state when power is start supplying to the controller; and clean the photosensitive drum when the sensor detects that the interlocking mechanism is in the second state when power is start supplying to the controller.

9. The image forming apparatus according to claim 8, further comprising a developer cartridge having the developing roller and attachable to inside of the housing through the opening with the cover being located at the open position.

10. The image forming apparatus according to claim 1, further comprising a power switch configured to be switchable between an on state and an off state, power supply to the controller being started when the power switch is in the on state, the power supply to the controller being stopped when the power switch is in the off state.

11. An image forming apparatus, comprising:

a housing formed with an opening;

a cover configured to be movable between a closed position at which the cover closes the opening and an open position at which the cover uncovers the opening;

a photosensitive drum;

a developing roller movable between a contact position at which the developing roller contacts the photosensitive drum and a separation position at which the developing roller is spaced from the photosensitive drum;

a separation mechanism configured to move the developing roller from the contact position to the separation position, the separation mechanism allowing movement of the developing roller from the separation position to the contact position in association with a movement of the cover from the closed position to the open position;

a controller configured to control the separation mechanism to move the developing roller between the separation position and the contact position;

an interlocking mechanism configured to change a state from a first state to a second state in association with the movement of the cover from the closed position to the open position when the cover moves from the closed position to the open position while no power is supplied is to the controller, and wherein the interlocking mechanism maintains the second state without associating with a movement of the cover from the open position to the closed position when the cover moves from the open position to the closed position while no lower is supplied to the controller; and a sensor configured to detect whether the interlocking mechanism is in the second state, wherein the separation mechanism is configured to when the sensor does not detect that the interlocking mechanism is in the second state when power supply to the controller is started, perform a first warm-up process of causing the separation mechanism to keep the developing roller located at the separation position at the separation position, and when the sensor detects that the interlocking mechanism is in the second state when power supply to the controller is started, perform a second warm-up process of causing the separation mechanism to move the developing roller located at the contact position to the separation position.

12. The image forming apparatus according to claim 11, further comprising:

a transfer device having a belt configured to contact the photosensitive drum and transfer toner on the photosensitive drum onto a sheet; and a belt cleaner configured to clean the belt, wherein the controller is configured to not allow the belt cleaner to clean the belt in the first warm-up process, and to cause the belt cleaner to clean the belt in the second warm-up process.

13. The image forming apparatus according to claim 11, further comprising a drum cleaner configured to clean the photosensitive drum, wherein the controller is configured to not allow the drum cleaner to clean the photosensitive drum in the first warm-up process, and to cause the drum cleaner to clean the photosensitive drum in the second warm-up process.

14. The image forming apparatus according to claim 11, further comprising a non-volatile memory, wherein the controller is configured to write in the memory that the developing roller is located at the contact position when the developing roller is to be located at the contact position, and write in the memory that the developing roller is located at the separation position when the developing roller is to be located at the separation position, and wherein the controller is further configured to when the memory stores that the developing roller is to be located at the separation position at a time when the power supply to the controller is started, perform the second warm-up process when the sensor detects that the interlocking mechanism is in the second state, and when the memory stores that the developing roller is to be located at the contact position at the time when the power supply to the controller is started, perform the second warm-up process without the sensor detecting whether the interlocking mechanism is in the second state.

* * * * *